US008123829B2

(12) United States Patent
Sato et al.

(10) Patent No.: US 8,123,829 B2
(45) Date of Patent: Feb. 28, 2012

(54) GAS-LIQUID SEPARATION DEVICE OF ENGINE

(75) Inventors: Yoshikazu Sato, Wako (JP); Noboru Kawaguchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 585 days.

(21) Appl. No.: 11/919,632

(22) PCT Filed: Jun. 23, 2006

(86) PCT No.: PCT/JP2006/312609

§ 371 (c)(1),
(2), (4) Date: Jan. 22, 2008

(87) PCT Pub. No.: WO2006/137520

PCT Pub. Date: Dec. 28, 2006

(65) Prior Publication Data

US 2009/0064642 A1 Mar. 12, 2009

(30) Foreign Application Priority Data

Jun. 23, 2005 (JP) ..... 2005-183596
Jun. 23, 2005 (JP) ..... 2005-183605

(51) Int. Cl.
*F01M 13/04* (2006.01)

(52) U.S. Cl. ..... 55/385.3; 55/406; 55/DIG. 14; 123/198 E; 123/573; 123/574

(58) Field of Classification Search ..... 55/385.3, 55/486, DIG. 28, 317, 318, 402, 409, 417, 55/459.1; 96/157, 174, 177, 210, 214; 123/198 E, 123/572, 573, 574; 210/512.1, 788
See application file for complete search history.

(56) References Cited

U.S. PATENT DOCUMENTS

| | | | | |
|---|---|---|---|---|
| 1,921,175 | A | 8/1933 | Towler | |
| 5,693,125 | A * | 12/1997 | Dean | 96/157 |
| 5,857,441 | A | 1/1999 | Yonezawa et al. | |
| 6,837,914 | B2 * | 1/2005 | Baek | 55/459.1 |
| 7,647,913 | B2 * | 1/2010 | Kohler et al. | 123/198 E |
| 2004/0134458 | A1 | 7/2004 | Chiba et al. | |

(Continued)

FOREIGN PATENT DOCUMENTS

GB 2 155 998 A 10/1985

(Continued)

*Primary Examiner* — Duane Smith
*Assistant Examiner* — Minh-Chau Pham
(74) *Attorney, Agent, or Firm* — Arent Fox LLP

(57) ABSTRACT

A bearing holder (66) having a bearing (67) rotatably supporting a crankshaft (14) is fixed so as to face an opening (11*k*) of the engine case (11). A gas-liquid separation chamber (83) is formed between a cover member (68) covering the opening (11*k*) and the bearing holder (66). Therefore, by utilizing the bearing holder (66) as a part of the wall surface of the gas-liquid separation chamber (83), the gas-liquid separation chamber (83) can be partitioned without increasing the number of components and without forming a special wall surface in the engine case (11). Thus, it is possible to reduce the size and weight of the engine case (11), and reduce the cost by simplifying the shape thereof and reducing the number of components. Also, a labyrinth 82 is formed by ribs (66*d*, 66*e*, 68*a*, 68*d*) projecting from the bearing holder (66) and the cover member (68), and therefore gas-liquid separation can be effectively performed by the labyrinth (82). Thus, it is possible to provide a small light gas-liquid separation device with a small number of components.

18 Claims, 24 Drawing Sheets

U.S. PATENT DOCUMENTS

| | | | | |
|---|---|---|---|---|
| 2005/0211093 | A1* | 9/2005 | Latulipe et al. | 95/270 |
| 2006/0237347 | A1* | 10/2006 | Kato et al. | 209/305 |
| 2008/0102082 | A1* | 5/2008 | Senin et al. | 424/195.16 |
| 2008/0196687 | A1* | 8/2008 | Kohler et al. | 123/198 E |

FOREIGN PATENT DOCUMENTS

| | | | |
|---|---|---|---|
| GB | 2 260 365 | A | 4/1993 |
| JP | 60-192821 | A | 10/1985 |
| JP | 61-105710 | U | 7/1986 |
| JP | 62-12820 | Y2 | 4/1987 |
| JP | 10-131733 | A | 5/1998 |
| JP | 11-101120 | A | 4/1999 |
| JP | 11-159398 | A | 6/1999 |
| JP | 2004-150413 | A | 5/2004 |
| JP | 2005-120973 | A | 5/2005 |

* cited by examiner

GAS-LIQUID SEPARATION DEVICE OF ENGINE

CROSS-REFERENCE TO RELATED APPLICATION

This application is a National Stage entry of International Application No. PCT/JP2006/312609, having an international filing date of Jun. 23, 2006; which claims priority to Japanese Application Nos.: JP 2005-183596 and JP 2005-183605, both filed Jun. 23, 2005, the disclosures of each of which is hereby incorporated in its entirety by reference.

TECHNICAL FIELD

The present invention relates to a gas-liquid separation device of an engine for separating oil mist from air in an engine case.

BACKGROUND ART

A conventional gas-liquid separation device is publicly known from the following Patent Publication 1 in which two mounting seats for mounting a breather case of a breather device having a gas-liquid separation function are provided on a ceiling wall and a peripheral wall of a crankcase of an engine, respectively, and the breather case is mounted on one of the two mounting seats which receives less oil droplets depending on the usage of the engine.

Patent Publication 1: Japanese Utility Model Publication No. 62-12820

DISCLOSURE OF THE INVENTION

Problems to be Solved by the Invention

The above-described conventional device has a disadvantage that the breather case projects from the surface of the crankcase to upsize the engine because a breather chamber is defined by a concave wall surface formed on the crankcase and the breather case mounted on the mounting seat, and also has a disadvantage that the shape of the crankcase is complicated because a concave wall surface is formed in the crankcase to partition a part of the breather chamber.

The present invention has been achieved in view of the above-mentioned circumstances, and has an object to provide a small light gas-liquid separation device of an engine which has a small number of components.

Means for Solving the Problems

In order to achieve the above object, according to a first feature of the present invention, there is provided a gas-liquid separation device of an engine for separating oil mist from air in an engine case, characterized in that a bearing holder comprising a bearing rotatably supporting a crankshaft is fixed so as to face an opening of the engine case, and a gas-liquid separation chamber is formed between a cover member covering the opening and the bearing holder.

The bearing corresponds to a ball bearing 67 in an embodiment of the present invention described later.

According to a second feature of the present invention, in addition to the first feature, a labyrinth is formed in the gas-liquid separation chamber by ribs projecting from at least one of the bearing holder and the cover member.

The ribs correspond to a fourth rib 66*d*, a fifth rib 66*e*, a first rib 68*a* and a second rib 68*b* in the embodiment of the present invention described later.

According to a third feature of the present invention, in addition to the second feature, the ribs projecting from the bearing holder and the ribs projecting from the cover member mutually overlap to form the labyrinth.

According to a fourth feature of the present invention, in addition to any of the first to third features, the air from which the oil mist is separated in the gas-liquid separation chamber is guided through a breather channel to a breather device to further perform gas-liquid separation.

According to a fifth feature of the present invention, in addition to the fourth feature, the breather channel is arranged on an upper part of the engine case.

According to a sixth feature of the present invention, in addition to the first feature, a part of the engine case is formed by a crank case having the opening on one side; a plurality of step portions facing the opening and aligned along a circumferential direction are formed on the inner peripheral wall of the crankcase; the opposite ends of the crankshaft are supported via bearings by the bearing holder which is fastened to the step portions and the other side wall of the crank case; and a reinforcement rib surrounding the plurality of step portions is formed integrally on an outer peripheral surface of the crankcase.

According to a seventh feature of the present invention, in addition to the sixth feature, a cylinder block is formed integrally on the crankcase to form the engine case, and an end of the reinforcement rib is connected integrally to the outer side wall of the cylinder block.

According to an eighth feature of the present invention, in addition to the sixth or seventh feature, an oil stirring chamber communicating with a crank chamber in the crankcase is defined between the bearing holder and the cover member, and a drive rotation member fixed on the crankshaft of a timing transmission system for valve operation is arranged in the oil stirring chamber.

According to a ninth feature of the present invention, in addition to the eighth feature, an oil slinger driven by the crankshaft to splash a lubricant oil stored in the oil stirring chamber is arranged in the oil stirring chamber, and a rib for guiding the lubricant oil splashed by the oil slinger to the timing transmission system side is formed in the bearing holder.

Effect of the Invention

With the arrangement of the first feature, the baring holder comprising the bearing rotatably supporting the crankshaft is fixed so as to face the opening of the engine case, and the gas-liquid separation chamber is formed between the cover member covering the opening and the bearing holder. Therefore, the bearing holder can be used as a part of a wall surface of the gas-liquid separation chamber to partition the gas-liquid separation chamber without increasing the number of components and without forming a special wall surface in the engine case. Consequently, the size and weight of the engine case can be reduced, the shape of the engine case can be simplified, and the cost can be reduced due to reduction of the number of components.

With the arrangement of the second feature, a labyrinth is formed by the rib projecting from at least one of the bearing holder and the cover member, so that gas-liquid separation can be effectively performed by the labyrinth.

With the arrangement of the third feature, the rib projecting from the bearing holder and the rib projecting from the cover member are made to mutually overlap to form the labyrinth, so that a complicated labyrinth can be formed with a simple arrangement to further increase the gas-liquid separation effect.

With the arrangement of the fourth feature, the air from which oil mist is separated in the gas-liquid separation chamber is introduced into the breather device through the breather channel to further perform gas-liquid separation, so that the consumption of oil can further be reduced.

With the arrangement of the fifth feature, the breather channel is arranged in the upper part of the engine case, thereby minimizing the amount of the remaining oil mist which is not removed in the gas-liquid separation chamber and enters the breather channel.

With the arrangement of the sixth feature, the reinforcement rib couple the plurality of step portions inside the crankcase to one another on the outer peripheral surface of the crankcase, so that the support rigidity of the bearing holder supported by the step portions, and hence the support rigidity of the crankshaft supported by the bearing holder can be effectively enhanced, resulting in reduced thickness and weight of the crankcase.

With the arrangement of the seventh feature, the end of the reinforcement rib is coupled integrally to the side wall of a cylinder block, so that the reinforcement function of the reinforcement rib is further improved, and the support rigidity of the bearing holder can be further enhanced.

With the arrangement of the eighth feature, a space between the bearing holder and the cover member can be effectively used for installation of the timing transmission system for valve operation, thereby contributing to decrease in the size of the engine.

With the arrangement of the ninth feature, the rib is formed in the bearing holder, so that the oil splashed by the oil slinger can be guided to the timing transmission system side, and the bearing holder can be easily molded together with the rib because the bearing holder is a relatively small component.

The above-mentioned object, other objects, characteristics, and advantages of the present invention will become apparent from a preferred embodiment, which will be described in detail below by reference to the attached drawings.

EXPLANATION OF REFERENCE NUMERALS AND SYMBOLS

Figure 1:
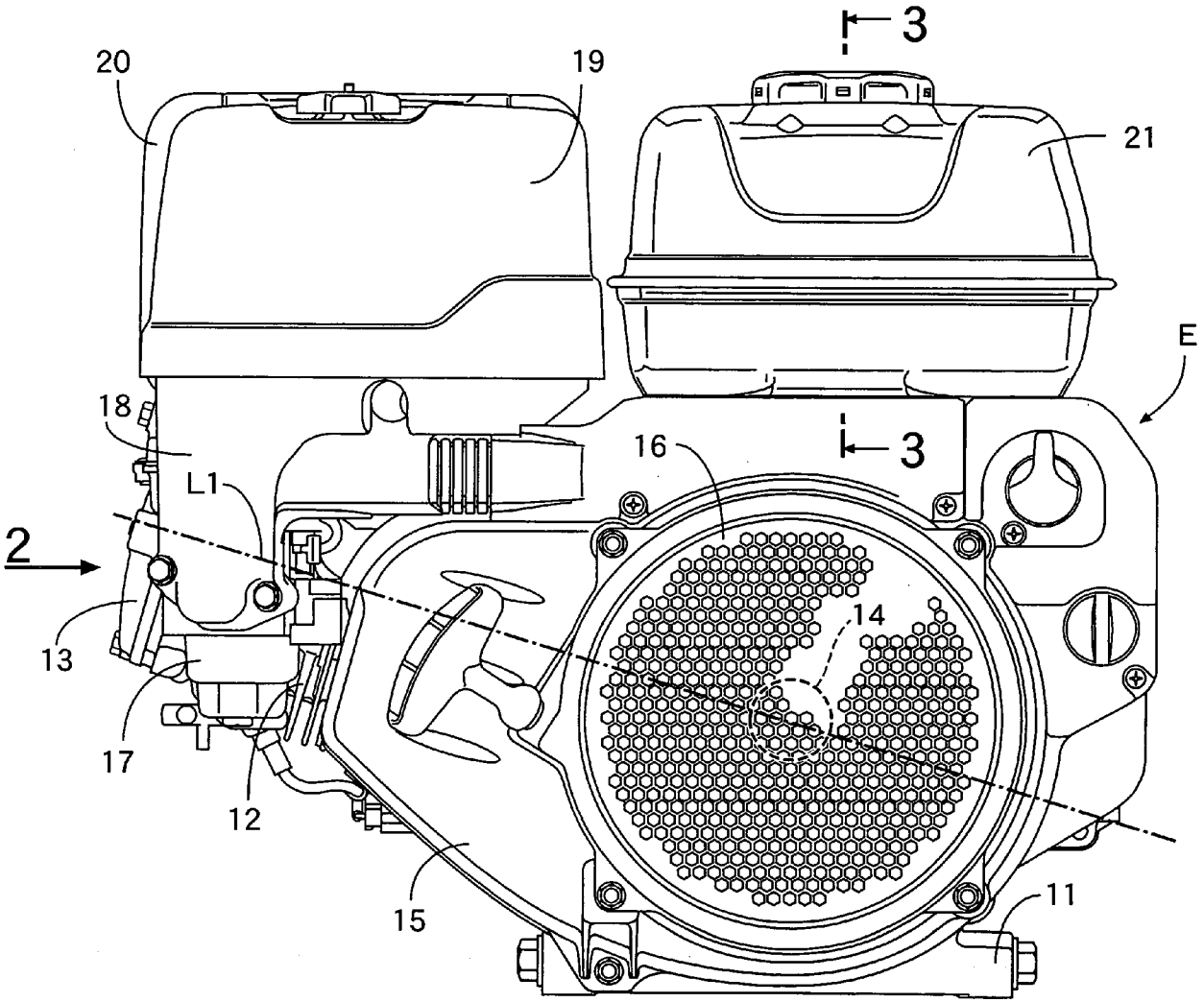
FIG. 1 is a front view of a general-purpose four-cycle engine. (first embodiment)

11 engine case
11*e* breather chamber
11*k* opening
14 crankshaft
52 breather device
64 bearing
66 bearing holder
66*b*, 66*d*, 66*e*, 68*a*, 68*b* rib
67 bearing
68 cover member
70 oil stirring chamber
77 oil slinger
80 drive rotation member
82 labyrinth
83 gas-liquid separation chamber
102 crankcase
103 cylinder block
108, 108 step portion
109 crank chamber
116 reinforcement rib
137 timing transmission system
171 storing lubricant oil

BEST MODE FOR CARRYING OUT THE INVENTION

A preferred embodiment of the present invention is explained below with reference to the accompanying drawings.

Embodiment 1

Figure 2:
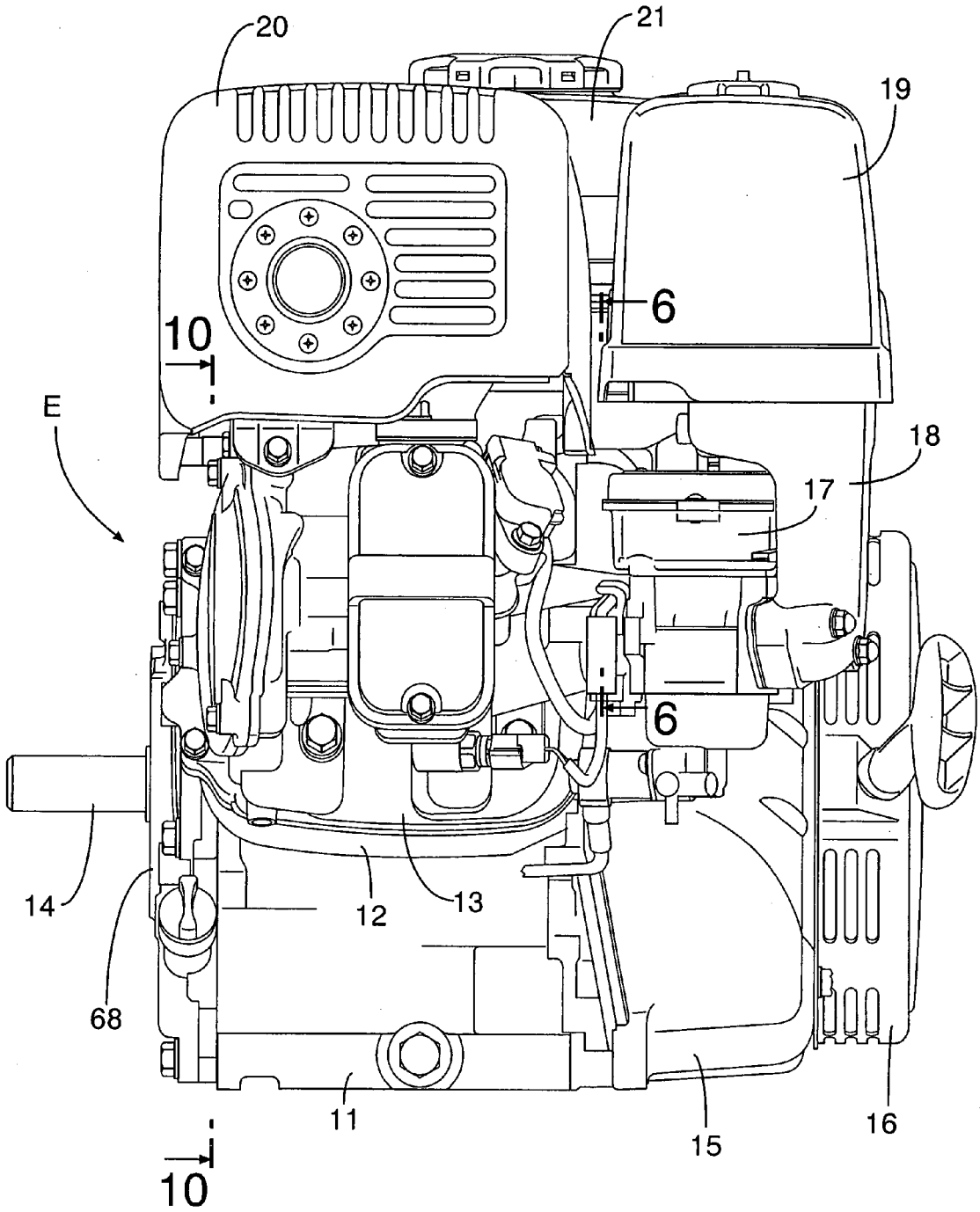
FIG. 2 is a view of FIG. 1 viewed in the direction of arrow 2. (first embodiment)
Figure 3:
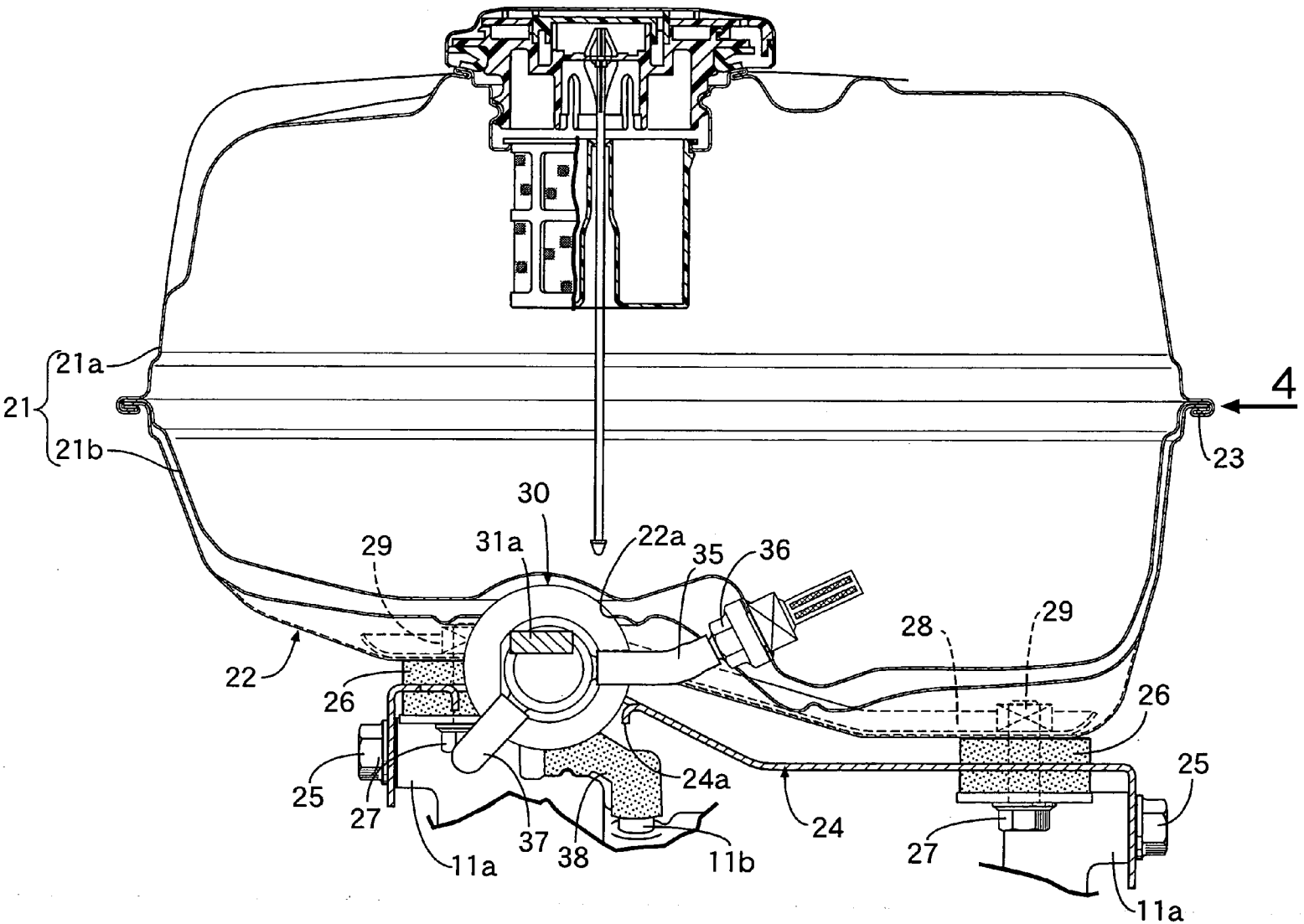
FIG. 3 is an enlarged sectional view taken along the 3-3 line in FIG. 1. (first embodiment)
Figure 4:
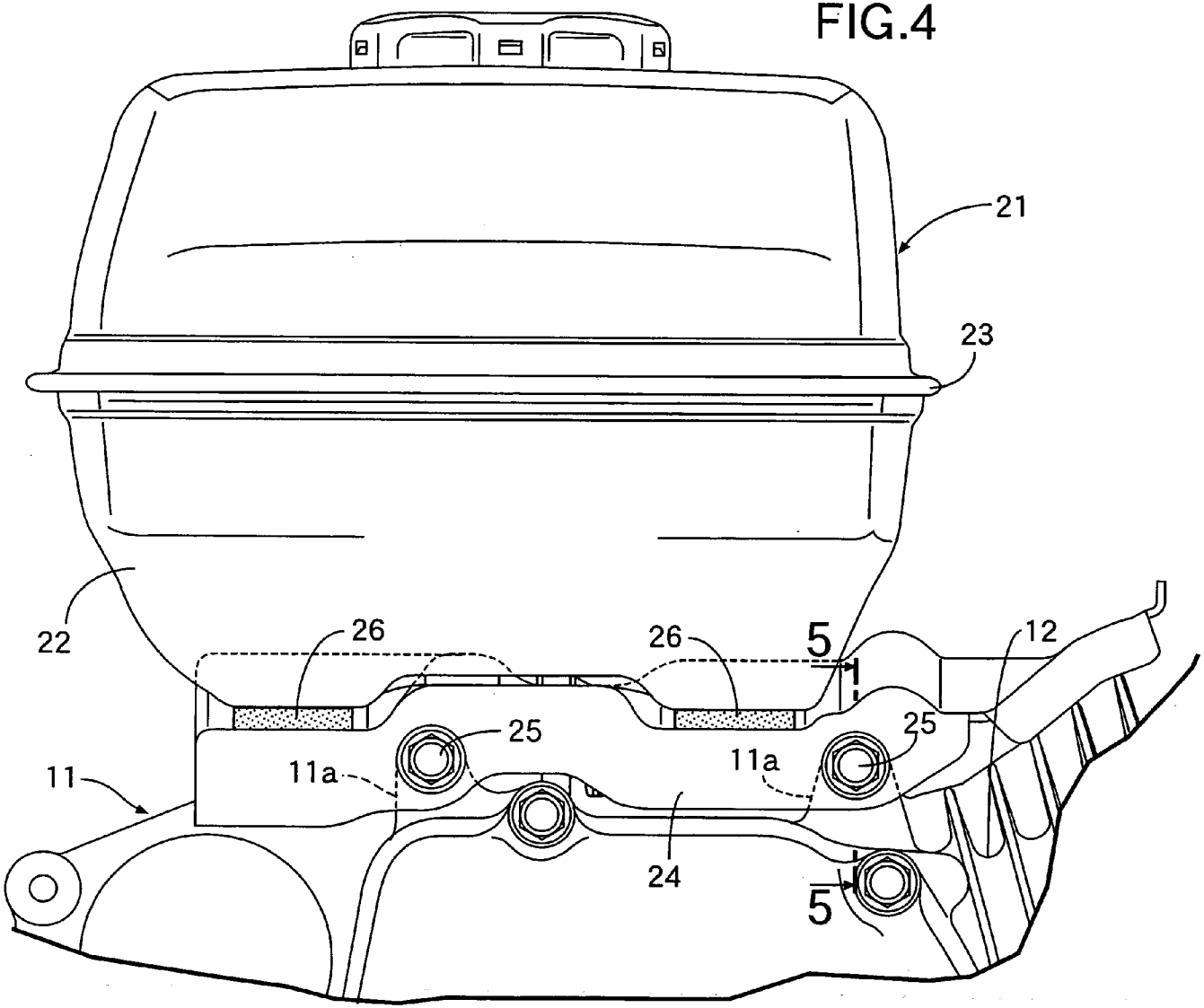
FIG. 4 is a view of FIG. 3 viewed in the direction of arrow 4. (first embodiment)
Figure 5:
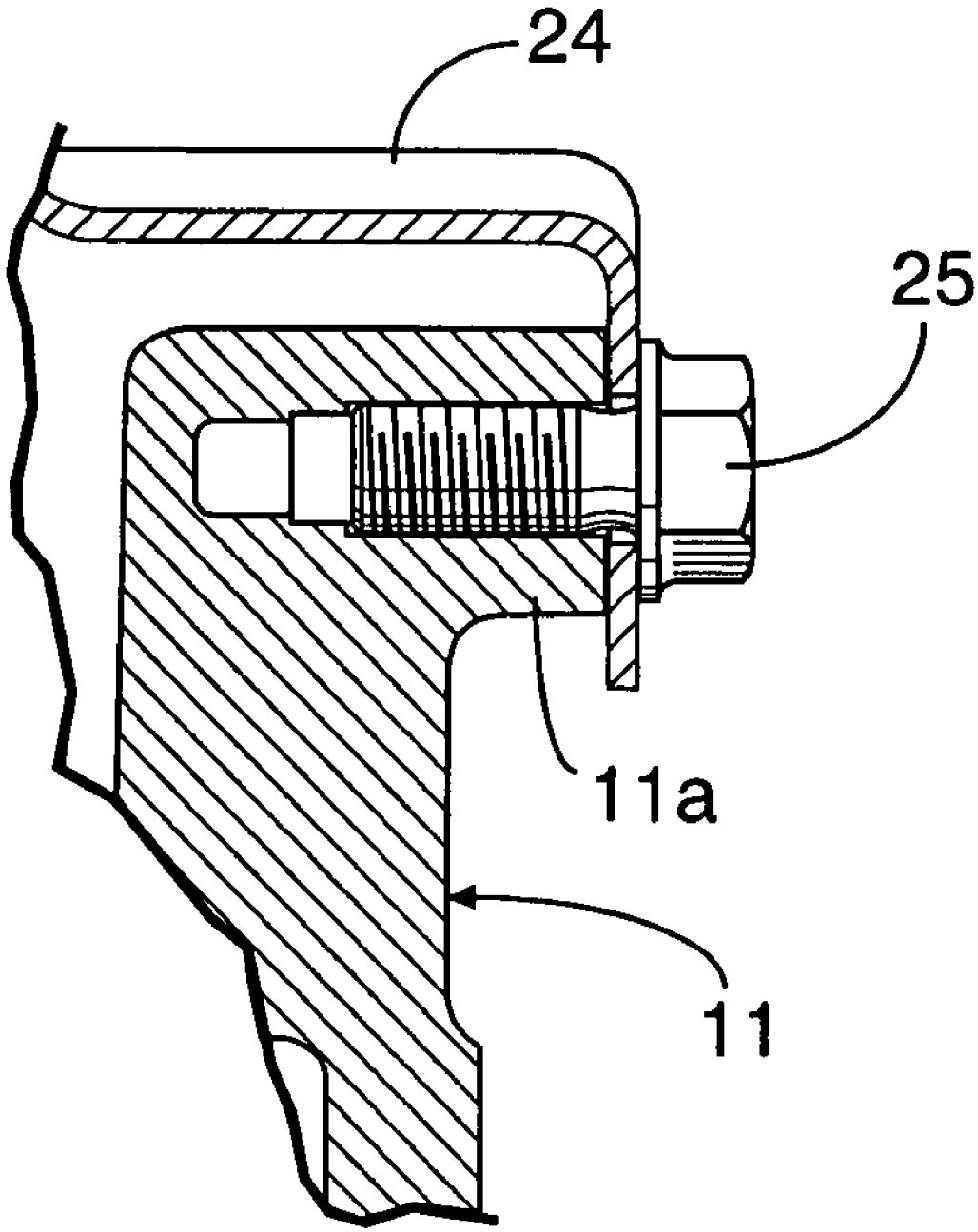
FIG. 5 is an enlarged sectional view taken along the 5-5 line in FIG. 4. (first embodiment)

As shown in FIGS. 1 and 2, a single-cylinder four-cycle engine E is arranged with a cylinder axis line L1 slightly inclined so that a cylinder head 12 and a head cover 13 are high with respect to an engine case 11 integrally having a crankcase and a cylinder block. A crankshaft 14 projects from one of end surfaces of the engine case 11. A recoil starter 16 for cranking a crankshaft 14 to start the engine is provided on the outer surface of a cover 15 covering the other end surface of the engine case 11. A carburetor 17 is provided on the side part of the cylinder head 12. An air intake channel 18 extending upward from the carburetor 17 is connected to an air cleaner 19. A muffler 20 is mounted on the upper parts of the cylinder head 12 and the head cover 13 so as to align with the air cleaner 19. A fuel tank 21 is mounted at a position closer to the crankcase than to the air cleaner 19 and the muffler 20.

The fuel tank 21 is formed by integrally coupling the lower edge of a tank upper part 21*a*, the upper edge of a tank lower part 21*b* and the upper edge of a tank holder 22 by a crimping portion 23. A tank stay 24 is fixed by bolts 25 on four mounting bolts 11*a* projectingly provided on the engine case 11. The outer peripheries of four rubber bushes 26 are supported on the upper surface of the tank stay 24. A bolt 27 passing upward through the center of each rubber bush 26 passes through the tank holder 22 and a reinforcement plate 28, and is fastened to a nut 29, whereby the fuel tank 21 is supported above the engine case 11 in a vibration-isolating manner.

As shown in FIG. 3 and FIGS. 6 to 8, an automatic fuel cock 30 automatically feeding fuel in the fuel tank 21 to carburetor 17 during operation of the engine E is mounted on the lower surface of the fuel tank 21. The automatic fuel cock 30 comprises a first housing 31 and a second housing 32 which are integrally coupled to each other. A stay 31*a* (see FIG. 6) protruding from the first housing 31 is fixed on the lower surface of the tank holder 22 by a bolt 33 and a nut 34. At this time, the upper part of the automatic fuel cock 30 protrudes upward through an opening 22*a* (see FIG. 7) of the tank holder 22, and the lower part of the automatic fuel cock 30 protrudes downward through an opening 24*a* (see FIGS. 3 and 6) of the tank stay 24.

Figure 8:
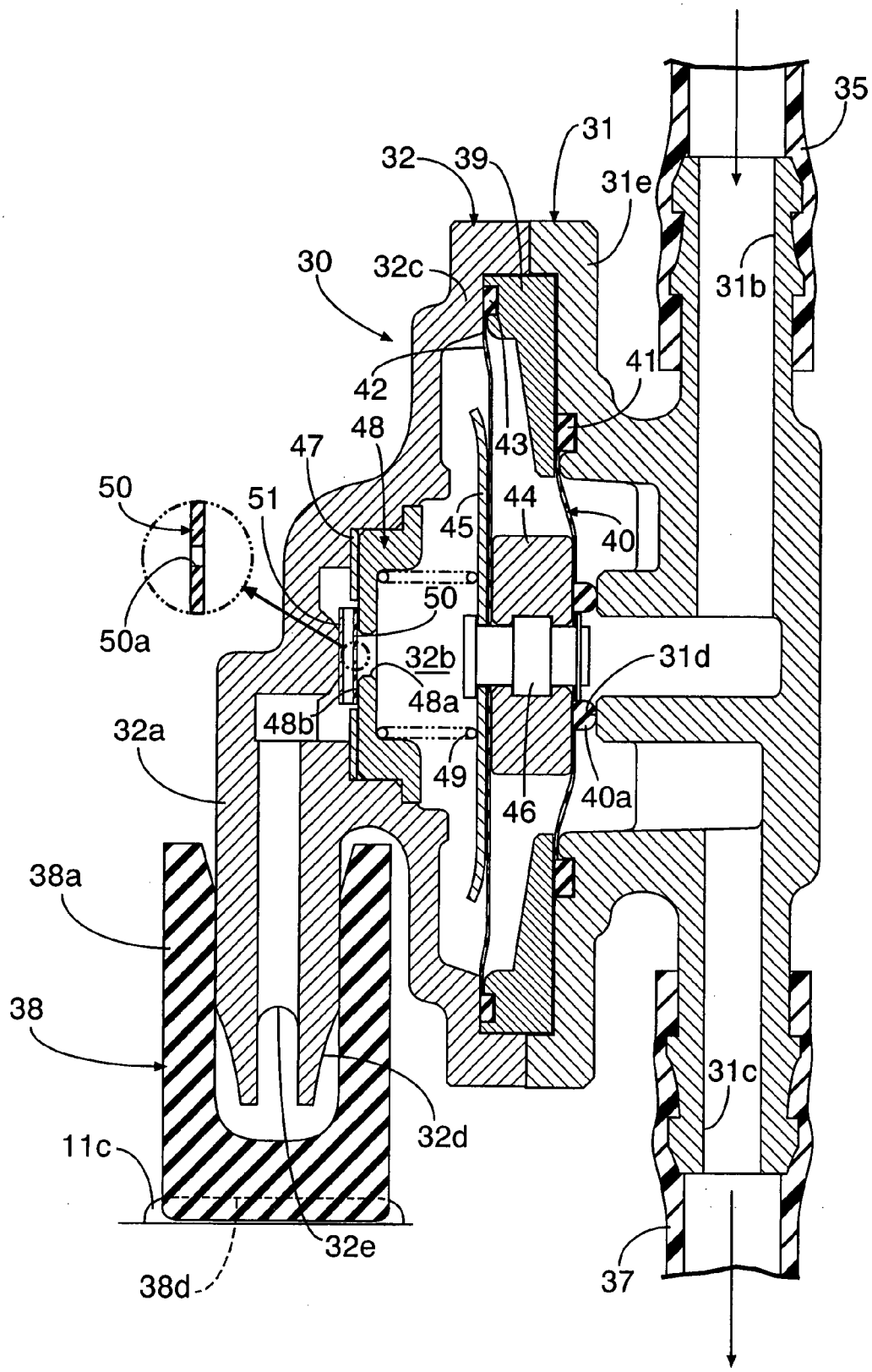
FIG. 8 is an enlarged sectional view taken along the 8-8 line in FIG. 7. (first embodiment)

As best shown in FIG. 8, the first housing 31 of the automatic fuel cock 30 comprises: a fuel inlet joint 31*b*; a fuel outlet joint 31*c*; a valve seat 31*d* formed between the fuel inlet joint 31*b* and the fuel outlet joint 31*c*; and a disc-shaped diaphragm support portion 31*e*. The second housing 32 comprises: a first negative pressure introduction joint 32*a*; a negative pressure chamber 32*b* communicating with the first negative pressure introduction joint 32*a*; and a disc-shaped diaphragm support portion 32*c*. The fuel inlet joint 31*b* is connected to a joint 36 provided on the lower surface of the fuel tank 21 via a first fuel hose 35. The fuel outlet joint 31*c* is connected to the carburetor 17 via a second fuel hose 37. The first negative pressure introduction joint 32*a* is connected to a second negative pressure introduction joint 11*b* of the engine case 11 via a negative pressure tube 38 made of rubber. By using the negative pressure 38 made of rubber, the degree of freedom in the layout of the fuel tank 21 can be improved with respect to the engine case 11.

An annular diaphragm support member 39 is sandwiched between the diaphragm support portion 31*e* of the first housing 31 and the diaphragm support portion 32*c* of the second housing 32. The outer periphery of a first diaphragm 40 is fixed between the diaphragm support portion 31*e* of the first housing 31 and the diaphragm support member 39 via a seal member 41. The outer periphery of a second diaphragm 42 is fixed between the diaphragm support portion 32*c* of the second housing 32 and the diaphragm support member 39 via a seal member 43. The first and second diaphragms 40 and 42, a spacer block 44 sandwiched between the central portions of the first and second diaphragms 40 and 42, and a disk-shaped spring sheet 45 in contact with the rear surface of the second diaphragm 42 are fixed integrally by a rivet 46 passing through them.

A valve seat forming member 48 is fitted between the first negative pressure introduction joint 32*a* and the negative pressure chamber 32*b* of the second housing 32 via a spacer plate 47. A valve spring 49 arranged between the valve seat forming member 48 and the spring sheet 45 urges a valve body 40*a* formed at the central part of the first diaphragm 40 in the direction to be seated on the valve seat 31*d* of the first housing 31. Fixed to the valve seat forming member 48 by a bolt (not shown) are one end of a lead valve 50 capable of being seated on a valve seat 48*b* facing a through hole 48*a* passing through the center of the valve seat forming member 48, and one end of a stopper 51 covering the outside thereof and regulating a range of motion of the lead valve 50. A very small through hole 50*a* is formed in the lead valve 50 to provide communication between the first negative pressure introduction joint 32*a* and the negative pressure 32*b*.

Figure 7:
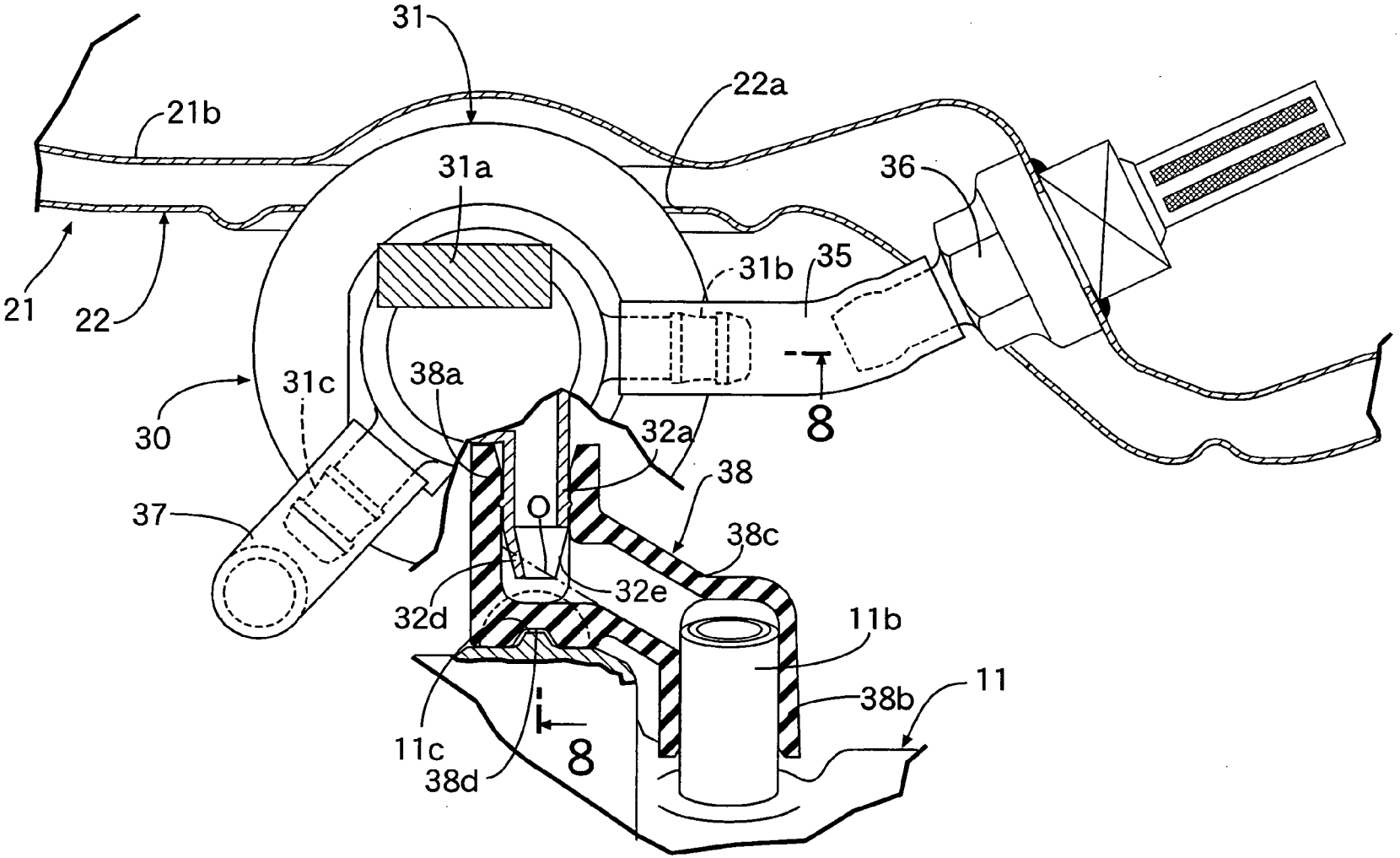
FIG. 7 is an enlarged sectional view taken along the 7-7 line in FIG. 6. (first embodiment)

As apparent from FIGS. 7 and 8, a taper portion 32*d* for facilitating insertion of the negative pressure tube 38 is formed at the lower end of the first negative pressure introduction joint 32*a*, and a reverse U-shaped notch 32*e* is formed on the taper portion 32*d*. The negative pressure tube 38 comprises: a first coupling portion 38*a* extending in a vertical direction and inserted into the first negative pressure introduction joint 32*a*; a second coupling portion 38*b* extending in a vertical direction and inserted into the second negative pressure introduction joint 11*b*; and an intermediate portion 38*c* extending obliquely downward from the lower end of the first coupling portion 38*a* to the upper end of the second coupling portion 38*b*. The negative pressure tube 38 is generally formed into the shape of a crank. A linear recessed portion 38*d* is formed on the bottom surface of the first coupling portion 38*a*. A linear protrusion 11*c* is formed on the upper surface of the engine case 11 facing the bottom surface of the first coupling portion 38*a* of the negative pressure tube 38 so as to be engaged in the linear recessed portion 38*d*, and this engagement between the protrusion 11*c* and the recessed portion 38*d* positions the negative pressure tube 38 in a direction of rotation about an vertical axis.

Figure 6:
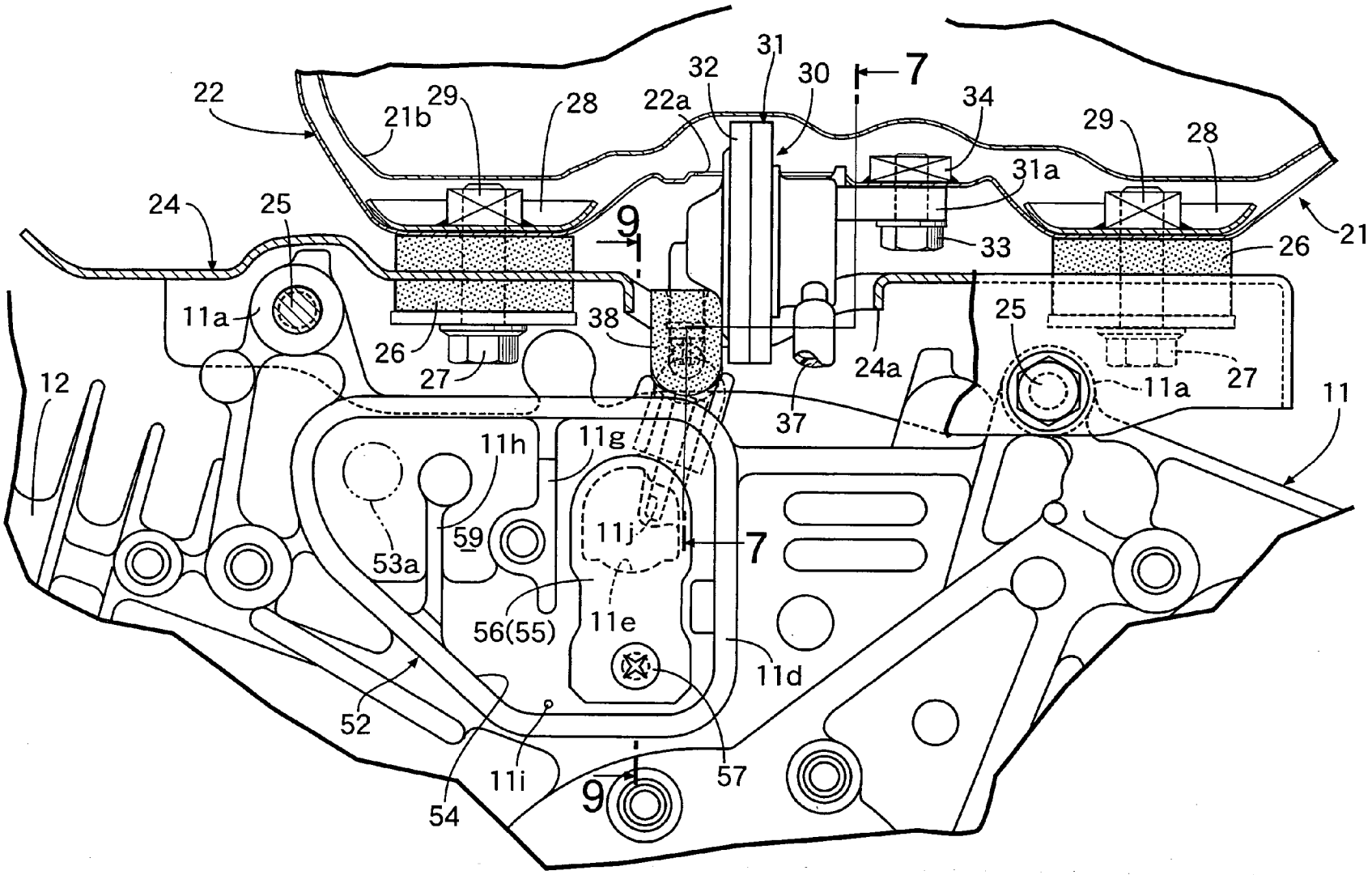
FIG. 6 is an enlarged sectional view taken along the 6-6 line in FIG. 2. (first embodiment)
Figure 9:
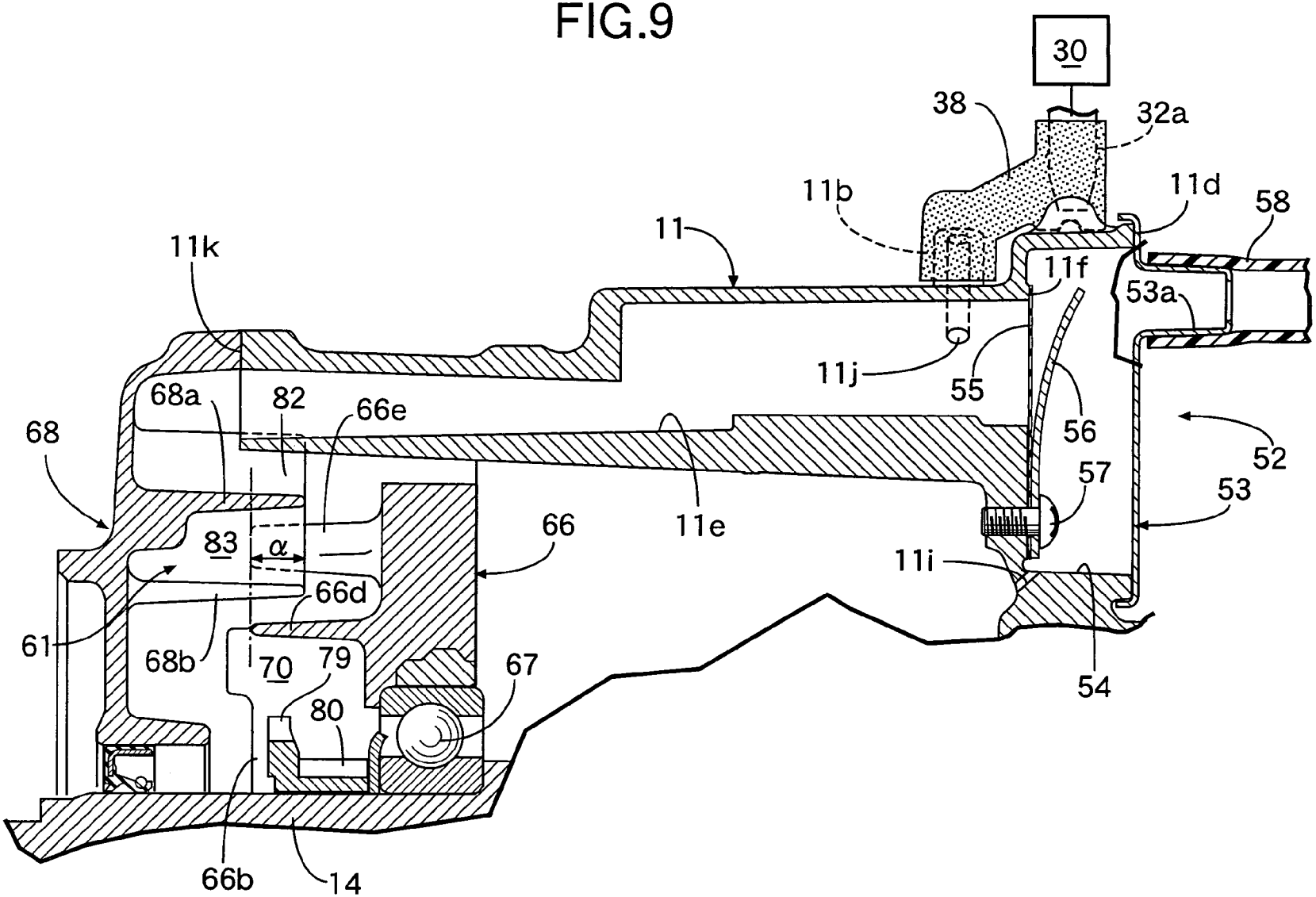
FIG. 9 is an enlarged sectional view taken along the 9-9 line in FIG. 6 and FIG. 10. (first embodiment)

As apparent from FIGS. 6 and 9, a breather device 52 provided on the side surface of the engine case 11 comprises a breather chamber 54 surrounded by an annular peripheral wall 11*d* and a cover 53. A breather chamber 11*e* is opened at one end of the breather chamber 54. Fixed to the inner wall of the breather chamber 54 by a bolt 57 are one end of a lead valve 55 capable of being seated on a valve seat 11*f* formed in the opening of the breather channel 11*e*, and one end of a stopper 56 regulating a range of motion of the lead valve 55. A joint 53*a* is formed on the cover 53 such that the joint 53*a* faces the other end of the breather chamber 54 distant from the breather channel 11*e*. The joint 53*a* is connected to an air intake system of the engine E via a breather pipe 58. Two ribs 11*g* and 11*h* are projectingly provided in the breather chamber 54 to form a labyrinth 59 between the breather channel 11*e* and the joint 53*a*. The bottom of the breather chamber 54 communicates with the inner space of the engine case 11 via an oil return hole 11*i*. A communicating hole 11*j* passes through the interior of the second negative pressure introduction joint 11*b* to which the second coupling portion 38*b* of the negative pressure tube 38 is fitted, and communicates with the breather channel 11*e*.

The structure of a gas-liquid separation device 61 of the engine E will now be described based on FIGS. 9 to 12.

The crankshaft 14 of the engine E has a pin portion 14*a* connected to a piston 63 via a connecting rod 62. One journal portion 14*b* of the crankshaft 14 is supported on the engine case 11 via a ball bearing 64, and the other journal portion 14*c* is supported on a bearing holder 66 fixed by six bolts 65 in the engine case 11 via a ball bearing 67. A cover member 68 is fixed by nine bolts 69 in an opening 11*k* of the engine case 11 so as to cover the front surface of the bearing holder 66. An oil stirring chamber 70 storing lubricant oil 171 on the bottom is defined between the cover member 68 and the bearing holder 66.

Opposite ends of a primary balancer shaft 73 (see FIG. 12) are supported between the engine case 11 and the bearing holder 66 via a pair of ball bearings 71 and 72. A drive gear 74 provided on the crankshaft 14 engages with a driven gear 75 provided on the primary balancer shaft 73, whereby the primary balancer shaft 73 rotates at a speed equal to the speed of rotation of the crankshaft 14.

An oil slinger 77 is rotatably supported on the bottom of the oil stirring chamber 70 via a rotor shaft 76. A driven gear 78 provided on the rotor shaft 76 is engaged with a drive gear 79 provided on the crankshaft 14, whereby the oil slinger 77 is rotated by the crankshaft 14. A timing belt 81 wound around a drive pulley 80 provided on the crankshaft 14 is connected to a driven pulley (not shown) provided on the cylinder head 12.

Figure 10:
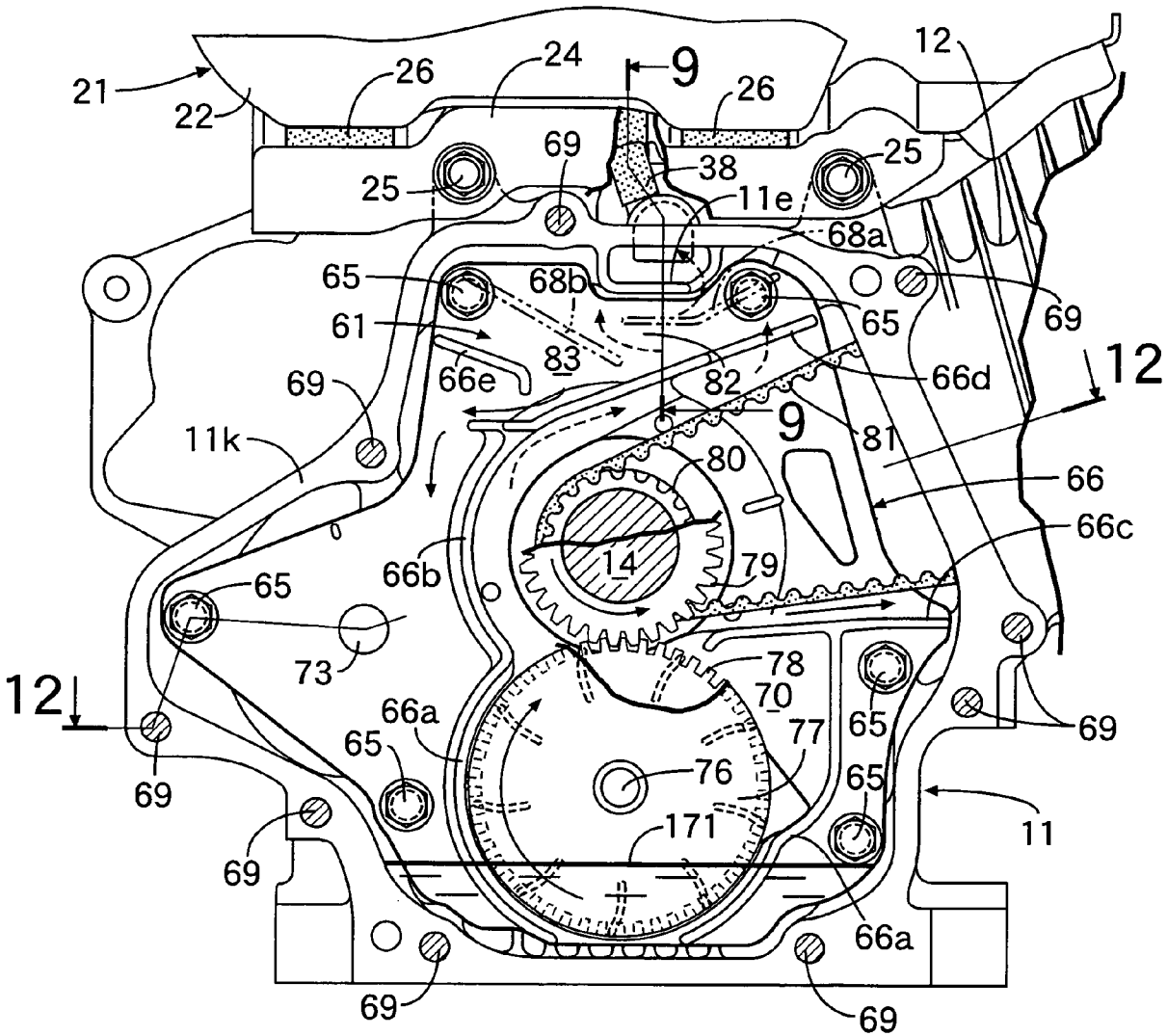
FIG. 10 is an enlarged view taken along the 10-10 line and viewed in the direction of the arrow in FIG. 2. (first embodiment)
Figure 11:
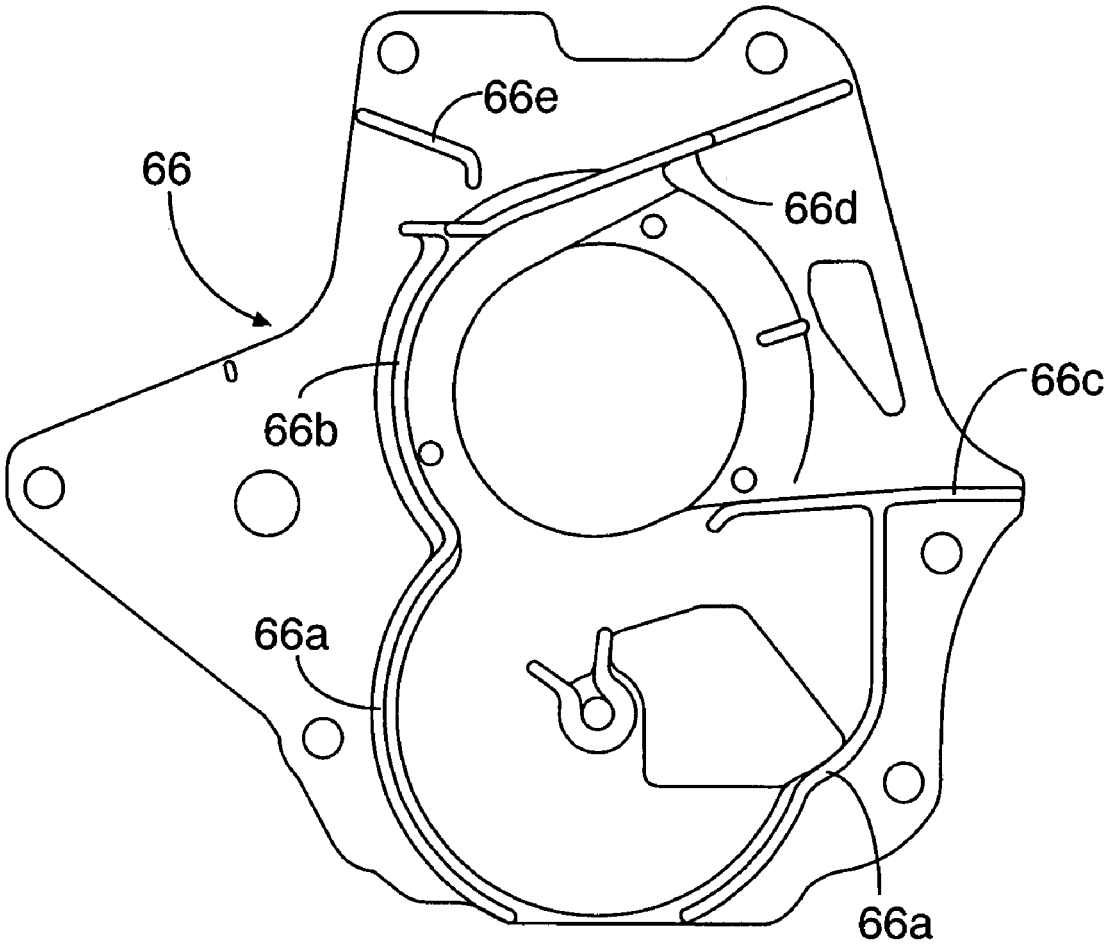
FIG. 11 is a view of a part of FIG. 10. (first embodiment)
Figure 12:
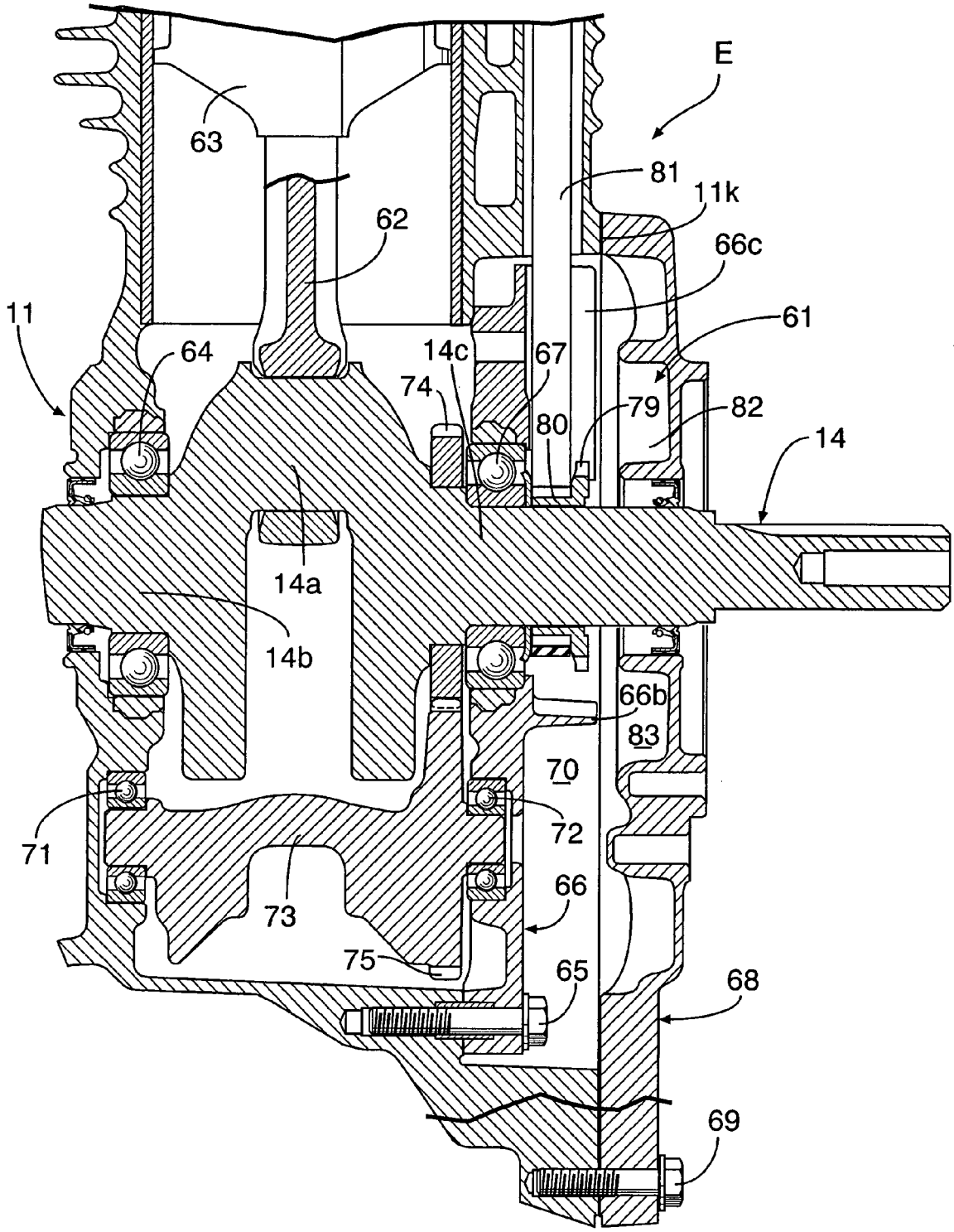
FIG. 12 is a sectional view taken along the 12-12 line in FIG. 10. (first embodiment)

As apparent from FIGS. 10 and 11, projectingly provided on the side surface of the bearing holder 66 are a first rib 66*a* surrounding a part of the outer periphery of the oil slinger 77, a second rib 66*b* surrounding a part of the outer peripheries of the drive gear 79 and the drive pulley 80, a third rib 66*c* leading to the end of the first rib 66*a* and extending along the lower surface of a chord on the lower side of the timing belt 81, a fourth rib 66*d* communicating with the end of the second rib 66*b* and extending along the upper surface of a chord on the upper side of the timing belt 81, and an independent fifth rib 66*e* extending obliquely in a direction opposite to a direction along which the fourth rib 66*d* extends obliquely from the vicinity of the connection between the second rib 66*b* and the fourth rib 66*d*. A first rib 68*a* and a second rib 68*b* substantially parallel to the fourth rib 66*d* and the fifth rib 66*e* of the bearing holder 66 are projectingly provided on the side surface of the cover member 68*a*.

A region surrounded by the first to fourth ribs 66*a* to 66*d* of the bearing holder 66 constitutes the oil stirring chamber 70. A gas-liquid separation chamber 83 having a labyrinth 82 constituted by the fourth and fifth ribs 66*d* and 66*e* of the bearing holder 66 and the first and second ribs 68*a* and 68*b* of the cover member 68 is defined outside the first to fourth ribs 66*a* to 66*d*. The upper part of the gas-liquid separation chamber 83 communicates with the breather device 52 via the breather channel 11*e* (see FIG. 9).

The operation of the above-described arrangement will be described.

In FIG. 10, when the engine E is operated, the oil slinger 77 connected to the crankshaft 14 via the drive gear 79 and the driven gear 78 rotates in the oil stirring chamber 70, and scoops up and splashes the oil accumulated on the bottom of the oil stirring chamber 70. The splashed oil is guided by the first and second ribs 66*a* and 66*b* of the bearing holder 66 to an area between the third and fourth ribs 66*c* and 66*d* extending along the timing belt 81, then deposited on the timing belt 81, and fed to a valve-operating chamber of the cylinder head 12 to lubricate a valve-operating mechanism. The valve-operating mechanism and the lubrication thereof will be described in detail later.

Air-containing oil mist generated in the oil stirring chamber 70 passes through the labyrinth 82 constituted by the fourth and fifth ribs 66*d* and 66*e* of the bearing holder 66 and the first and second ribs 68*a* and 68*b* of the cover member 68 in the gas-liquid separation chamber 83, and oil separated in this process falls along the first and second ribs 66*a* and 66*b* to be returned to the bottom of the oil stirring chamber 70.

The bearing holder 66 comprising the ball bearing 67 supporting the crankshaft 14 is fixed so as to face the opening 11*k* of the engine case 11. The gas-liquid separation chamber 83 is formed between the cover member 68 coupled to the opening 11*k* and the bearing holder 66, thus using the bearing holder 68 as a part of the wall surface of the gas-liquid separation chamber 83. Therefore, the number of components can be decreased as compared to a case where a part of the wall surface of the gas-liquid separation chamber 83 is constituted by a special member. Further, the size and weight of the engine case 11 can be reduced and the shape can be simplified as compared to a case where a part of the wall surface of the gas-liquid separation chamber 83 is constituted by a partition wall formed integrally with the engine case 11.

Moreover, the labyrinth 82 is provided in the gas-liquid separation chamber 83, thereby effectively separating the oil mist contained in the air in the engine case 11. Particularly, the fourth and fifth ribs 66*d* and 66*e* projecting from the bearing holder 66 side, and the first and second ribs 68*a* and 68*b* projecting from the cover member 68 side are made to mutually overlap by a distance $\alpha$ (see FIG. 9), thereby forming the complicated labyrinth 82 with a simple arrangement to further improve the gas-liquid separation effect.

In FIG. 9, the air from which the oil mist has been separated by the labyrinth 82 of the gas-liquid separation chamber 83 passes through the breather channel 11*e* and the lead valve 55 of the breather device 52, and is fed to the breather chamber 54. That is, a pressure pulsation generated with a reciprocation of the piston 63 is transmitted to the breather channel 11*e*, the lead valve 55 is opened when the breather channel 11*e* has a positive pressure, and the lead valve 55 is closed when the breather channel 11*e* has a negative pressure, whereby the air in the breather channel 11*e* is fed to the breather chamber 54.

In FIG. 6, the remaining oil which has not separated by the gas-liquid separation device 61 is also separated in the process that the air fed to the breather chamber 54 passes through the labyrinth 59 constituted by the ribs 11*g* and 11*h*. Lastly, the air is fed back to the bottom of the engine case 11 through an oil return hole 11*i* provided on the bottom of the breather chamber 54. Since gas-liquid separation is further performed for the air by the process that the air from which the oil mist has been separated by the gas-liquid separation device 61 is guided to the breather device 52 through the breather channel 11*e*, the consumption of oil can be further reduced. The air from which the oil mist has been removed as described above still contains fuel vapor blowing from a combustion chamber into the engine case 11, but the air containing the fuel vapor is fed back through the joint 53*a* of the cover 53 and the breather pipe 58 to the air intake system of the engine E where the fuel vapor is combusted together with a fuel-gas mixture, thereby preventing the fuel vapor from being emitted to the atmosphere.

In FIG. 9, the pressure pulsation in the engine case 11 is transmitted through the breather channel 11*e*, the through hole 11*j* and the negative pressure tube 38 to the first negative pressure introduction joint 32*a* of the automatic fuel cock 30. In FIG. 8, when the pressure transmitted to the first negative pressure introduction joint 32*a* of the automatic fuel cock 30 becomes a negative pressure, the lead valve 50 is separated from the valve seat 48*b* so that the negative pressure chamber 32*b* has the negative pressure; and conversely, when the pressure transmitted to the first negative pressure introduction joint 32*a* becomes a positive pressure, the lead valve 50 is seated on the valve seat 48*b* to keep the negative pressure in the negative pressure chamber 32*b*. Since the negative pressure chamber 32*b* always has a negative pressure during operation of the engine E, the first and second diaphragms 40 and 42 are moved to the left against the resilient force of the valve spring 49, and the valve body 40*a* formed in the first diaphragm 40 is separated from the valve seat 31*d*. As a result, fuel in the fuel tank 21 is fed to the carburetor 17 through the fuel inlet joint 31*b*, a gap between the valve seat 31*d* and the valve body 40*a*, the fuel outlet joint 31*c* and the second fuel hose 37.

When the engine E is stopped and the pressure pulsation in the breather channel 11*e* is eliminated, the lead valve 50 attracted in the right direction is seated on the valve seat 48*b* to seal the negative pressure chamber 32*b*, because the first and second diaphragms 40 and 42 are urged in the right direction in FIG. 8 by the resilient force of the valve spring 49. However, air flows from the first negative pressure introduction joint 32*a* into the negative pressure chamber 32*b* through the very small through hole 50*a* provided on the valve seat 50, and therefore the valve body 40*a* is seated on the valve seat 31*d* by the resilient force of the valve spring 49 to close the automatic fuel cock 30. Thus, the fuel supply from the fuel tank 21 to the carburetor 17 can be automatically stopped when the engine E is stopped.

The negative pressure tube 38 is coupled to the first and second negative pressure introduction joints 32*a* and 11*b* according to the following procedure. The tank stay 24 is assembled beforehand to the tank holder 22 of the fuel tank 21 via the rubber bushes 26, and further the automatic fuel cock 30 and the first fuel hose 35 are assembled beforehand to the tank holder 22. The second coupling portion 38*b* of the negative pressure tube 38 is fitted beforehand to the second negative pressure introduction tube 11*b* of the engine case 11. At this time, the recessed portion 38*d* on the bottom of the first coupling portion 38*a* of the negative tube 38 is engaged with the protrusion 11*c* of the engine case 11 (see FIG. 7), whereby the negative pressure tube 38 can be positioned in the rotational direction. In this state, the fuel tank 21 is made to approach the engine case 11 of the fuel tank 21 from above; the first negative pressure introduction joint 32*a* of the automatic fuel cock 30 is fitted to the first coupling portion 38*a* of the negative tube 38; and the tank stay 24 is then fixed to the engine case 11 by the bolts 25. The second fuel hose 37 communicating with the carburetor 17 is fitted to the fuel outlet joint 31*c* to complete the assembling.

As described above, since the negative pressure tube 38 can be connected to the first and second negative pressure introduction joints 32*a* and 11*b* by merely making the fuel tank 21 approach the engine case 11 from above, the mounting of the negative tube 38 is simplified. Further, the recessed portion 38*d* of the negative pressure tube 38 is engaged with the protrusion 11*c* of the engine case 11 to perform positioning, thereby facilitating the operation of fitting the first negative pressure introduction joint 32*a* of the automatic fuel cock 30 to the first coupling portion 38*a* of the negative pressure tube 38. The negative pressure tube 38 once attached has a limited vertical movement and is never detached unless the fuel tank 21 is removed, thereby eliminating the need of fastening the end of the negative pressure tube 38 with a clip or the like to prevent detachment.

If the operation of attachment of the negative pressure tube 38 were carried out after fixing the fuel tank 21 to the engine case 11, not only a workspace would be required for bending the negative pressure tube 38 to be fitted to the first and second negative pressure introduction joints 32*a* and 11*b*, but also the negative tube 38 itself would be upsized, and therefore it would become impossible to place the fuel tank 21 close to the engine case 11 to upsize the entire engine E.

If oil mist in the engine case 11 were accumulated in the negative pressure tube 38 or in the first negative pressure introduction joint 32*a*, the pressure pulsation of the breather channel 11*e* could not be transmitted to the negative pressure chamber 32*b* of the automatic fuel cock 30, and thus the automatic fuel cock 30 could fall into defective operation. However, according to this embodiment, air from which a most part of the oil mist has been removed by the gas-liquid separation device 61 is fed to the breather channel 11*e*, and the pressure pulsation of the breather channel 11*e* is guided to the automatic fuel cock 30, thus preventing the defective operation of the automatic fuel cock 30.

Particularly, the breather channel 11*e* for feeding air which has passed through the gas-liquid separation device 61 to the breather device 52 is provided on the upper part of the engine case 11, thereby further effectively preventing the oil mist from entering the breather channel 11*e*. Further, the pressure pulsation of the breather channel 11*e* is utilized to operate the automatic fuel cock 30, thereby eliminating the need of forming a special channel for transmitting the pressure pulsation to the automatic fuel cock 30.

Furthermore, the negative pressure tube 38 comprises: the first coupling portion 38*a* extending in a vertical direction and inserted into the first negative pressure introduction joint 32*a*; the second coupling portion 38*b* extending in a vertical direction and inserted into the second negative pressure introduction joint 11*b*; and the intermediate portion 38*c* extending obliquely downward from the lower end of the first coupling portion 38*a* to the upper end of the second coupling portion 38*b*. Therefore, even if oil mist enters the inside of the negative pressure tube 38, the oil mist is discharged to the breather channel 11*e* by gravitation without staying in the negative pressure tube 38, thereby avoiding a situation where the pressure pulsation is not transmitted to the automatic fuel cock 30.

Moreover, since the taper portion 32*d* is formed at the lower end of the first negative pressure introduction joint 32*a* of the automatic fuel cock 30, the insertion of the negative pressure tube 38 into the first coupling portion 38*a* is facilitated. Also, the notch 32*e* is formed on the taper portion 32*d*, and thus even if oil resides at the lower end of the first coupling portion 38*a* as shown by the chain line O in FIG. 7 when the engine E is tilted, the first negative pressure introduction joint 32*a* is prevented from being clogged by the effect of the notch 32*e*. Particularly, the notch 32*e* is opened toward the intermediate portion 38*c* side of the negative pressure tube 38, and therefore the notch 32*e* is further reliably prevented from being immersed under the oil level.

If the first negative pressure introduction joint 32*a* is cut at a position of the upper end of the taper portion 32*d* (i.e. a position of the upper end of the notch 32*e*), also the effect same as that by provision of the notch 32*e* can be obtained, but in this case it becomes difficult to insert the negative pressure tube 38 due to the absence of the taper portion 32*d*.

The automatic fuel cock 30 is operated not by an intake negative pressure of the engine E but by a larger negative pressure in the engine case 11, and therefore only cranking by the recoil starter 16 can generate a sufficient negative pressure to feed fuel to the carburetor 17. Particularly, by virtue of employment of two diaphragms, i.e. the first and second diaphragms 40 and 42, the automatic fuel cock 30 can be reliably operated even with a small negative pressure.

Surroundings of the engine case 11 and the bearing holder 66 will now be described a little more in detail with reference to FIGS. 13 to 16.

The engine case 11 comprises: a crankcase 102 having a mounting seat 2*a* in its lower part; a cylinder block 103 integrally connected to the crankcase 102 and having an upwardly slanted cylinder bore 3*a*; and a cylinder head 12 jointed to the upper end surface of the cylinder block 103 via a gasket 104. Four main coupling bolts 106, 106 arranged at four locations around the cylinder bore 3*a* and two auxiliary coupling bolts 107, 107 described later are used for joining, i.e. fastening the cylinder block 103 to the cylinder head 12.

The crankcase 102 has its one side surface opened. A plurality of step portions 108 facing the open surface side and aligned along a circumferential direction are formed integrally on the inner peripheral wall slightly inward from the open surface. The bearing holder 66 is fixed to the step portions 108 by a plurality of bolts 65. The opposite ends of the crankshaft 14 in a horizontal position are supported via the bearings 67 and 64 by the bearing holder 66 and the other sidewall of the crankcase 102. The opposite ends of the primary balancer shaft 73 arranged adjacently in parallel to the crankshaft 14 are supported via the bearings 71 and 72 by the bearing holder 66 and the other side wall of the crankcase 102.

Figure 16:
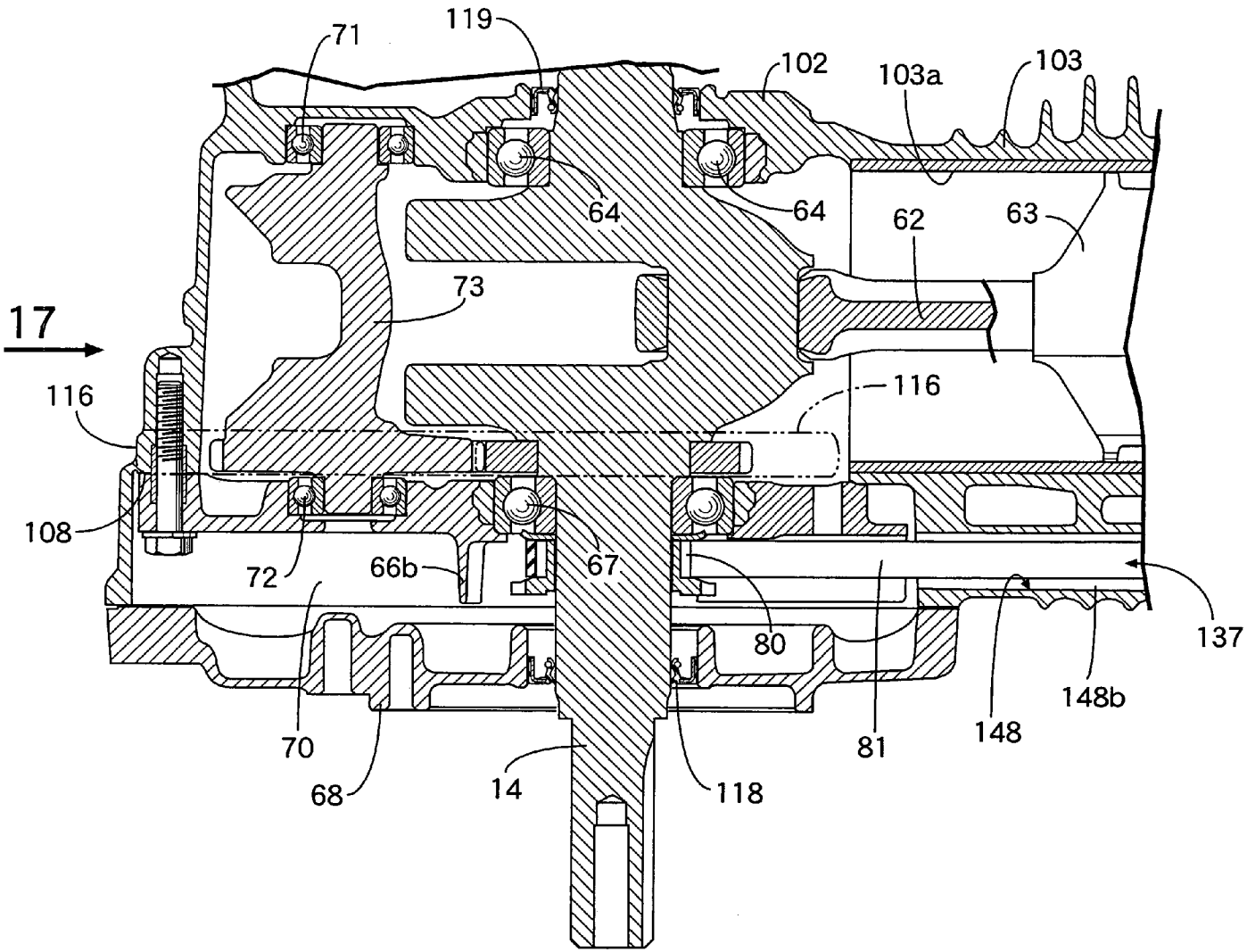
FIG. 16 is an enlarged view of the periphery of a crankshaft of FIG. 13. (first embodiment)
Figure 17:
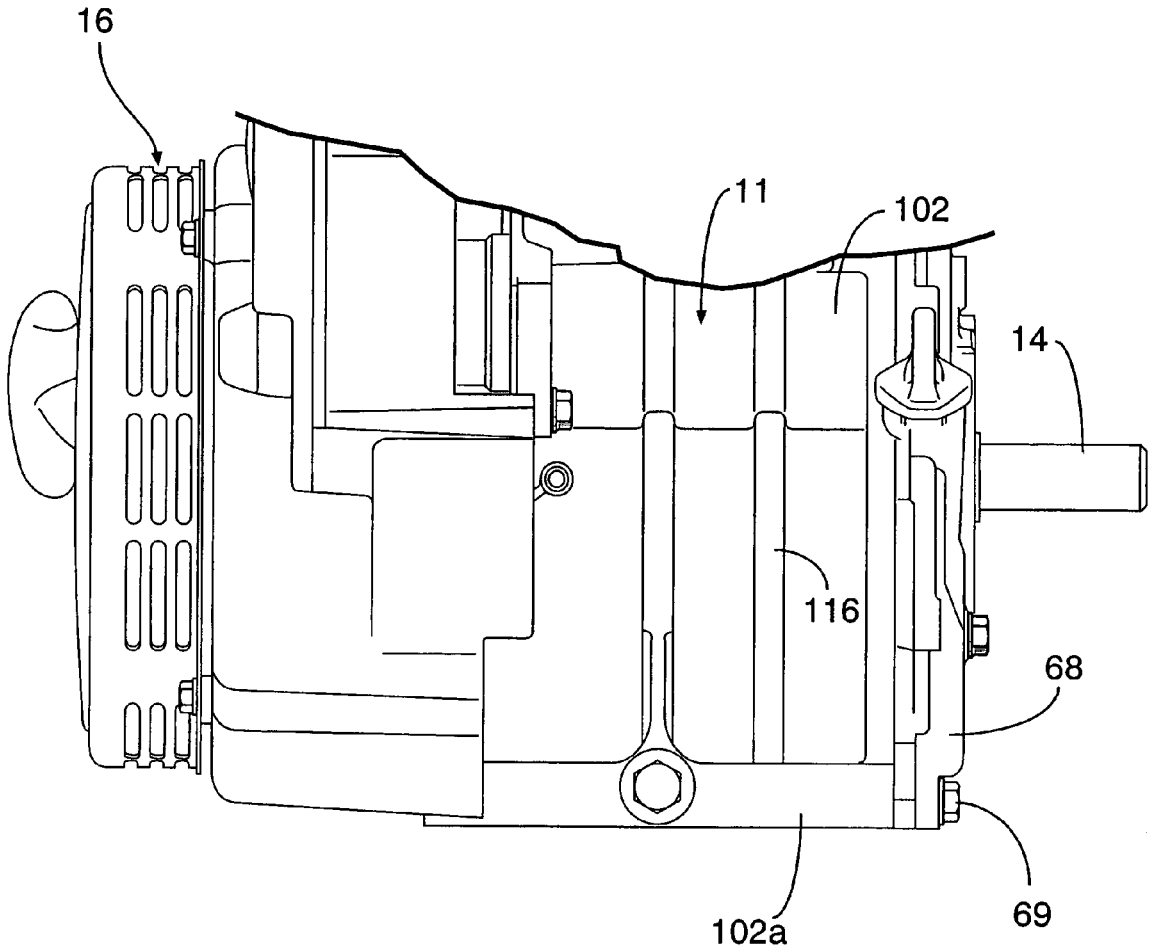
FIG. 17 is a view of FIG. 16 viewed in the direction of arrow 17. (first embodiment)

As shown in FIGS. 16 and 17, on the outer peripheral surface of the crankcase 102, a continuous reinforcement rib 116 is integrally formed so as to surround the plurality of step portions 108, and the end of the reinforcement rib 116 is integrally connected to the outer wall of the cylinder block 103 integral with the crankcase 102.

Thus, since the reinforcement rib 116 couples the plurality of step portions 108 inside the rib to one another on the outer peripheral surface of the crankcase 102, the support rigidity of the bearing holder 66 supported by the step portions 108, and hence the support rigidity of the crankshaft 14 supported by the bearing holder 66 can be effectively enhanced, resulting in reduced thickness and weight of the crankcase 102. Particularly, as a result of integrally connecting the end of the reinforcement rib 116 to the outer wall of the cylinder block 103, the reinforcement function of the reinforcement rib 116 is improved, and the support rigidity of the bearing holder 66 is enhanced.

The cover member 68 closing the open surface on one side of the crankcase 102 is jointed to the crankcase 102 by a plurality of bolts 69. One end of the crankshaft 14 passes through the cover member 68 and projects outward as an output shaft portion. An oil seal 118 in close contact with the outer peripheral surface of the output shaft portion is attached to the cover member 68.

Figure 13:
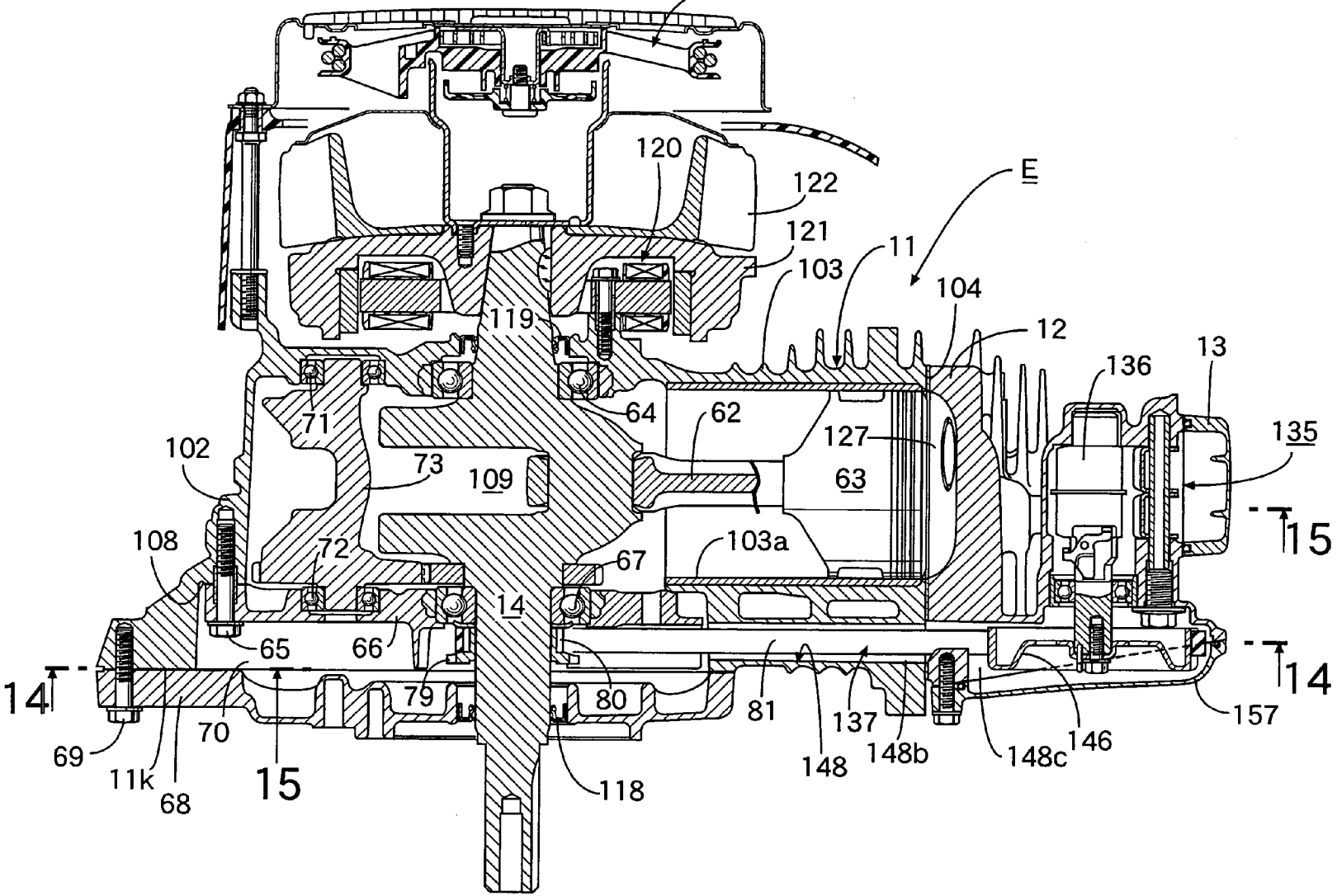
FIG. 13 is a longitudinal sectional plan view of the engine. (first embodiment)

Referring again in FIG. 13, the other end of the crankshaft 14 passes through the other side wall of the crankcase 102, and an oil seal 119 in close contact with the other end of the crankshaft 14 is attached to the other side wall of the crankcase 102 so as to be adjacent to the outside of the bearing 64. A fly wheel 121 serving also as a rotor of a generator 120 is fixed to the other end of the crankshaft 14. A cooling fan 122 is provided on the outer surface of the fly wheel 121. Further, at the other end of the crankshaft 14, the recoil stator 16 supported by the crankcase 102 is arranged in a face-to-face manner.

Figure 15:
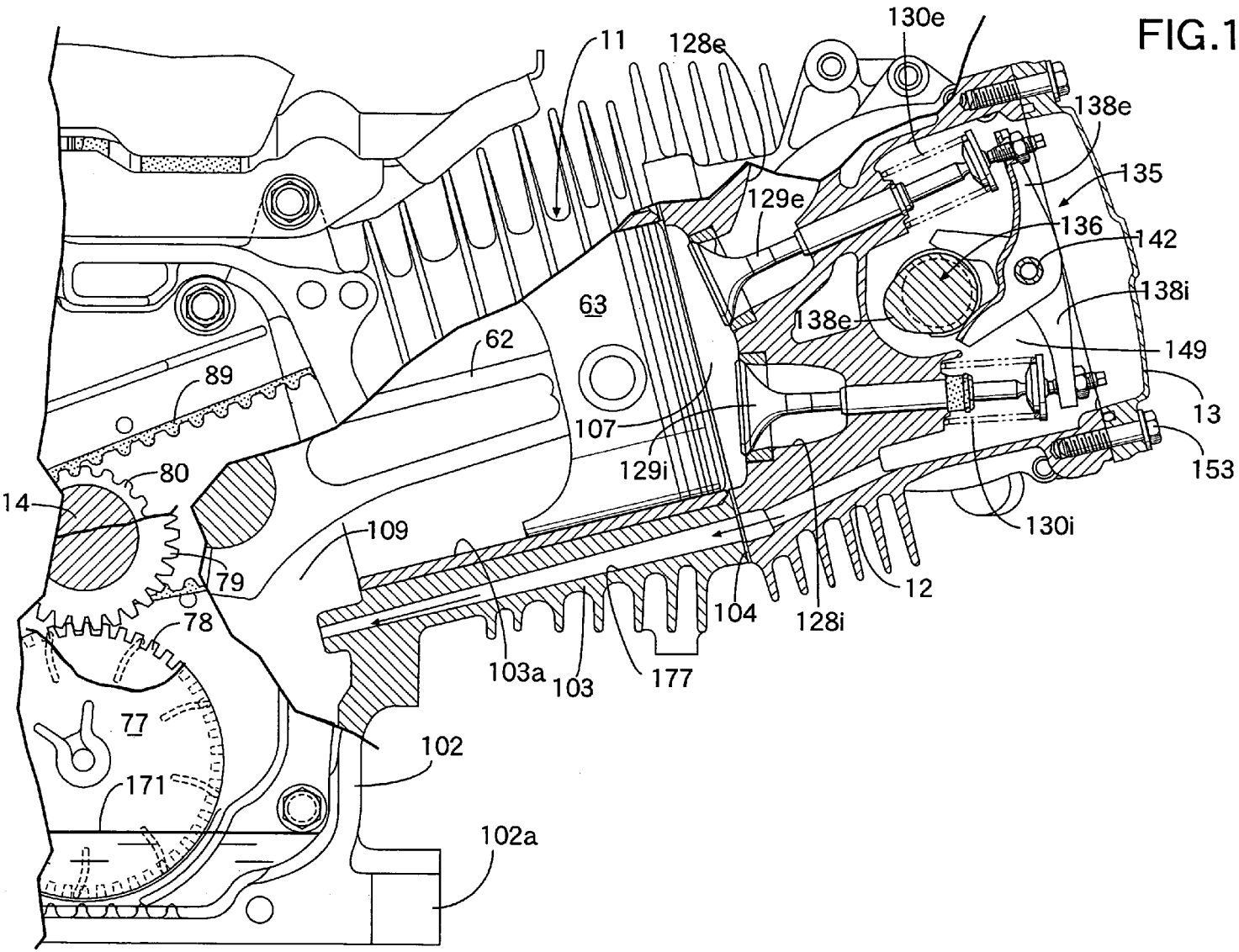
FIG. 15 is a sectional view taken along the 15-15 line in FIG. 13. (first embodiment)

In FIGS. 13 and 15, the piston 63 fitted to the cylinder bore 103*a* is connected to the crankshaft 14 via the connecting rod 62. Formed on the cylinder head 12 are a combustion chamber 127 communicating with the cylinder bore 103*a*, and an intake port 128*i* and an exhaust port 128*e* each opened in the combustion chamber 127. An intake valve 129*i* and an exhaust valve 129*e* are mounted to the cylinder head 12 so as to open and close the opening ends of the intake and exhaust ports 128*i* and 128*e*, respectively, opening to the combustion chamber 127. Valve springs 130*i* and 130*e* are attached to the intake and exhaust valves 129*i* and 129*e*, respectively, to urged them in a closing direction. The intake and exhaust valves 129*i* and 129*e* are opened and closed by a valve-operating system 135 operatable in association with the valve springs 130*i* and 130*e*.

The valve-operating system 135 will be described with reference to FIGS. 15, 16 and 18 to 24C.

Figure 18:
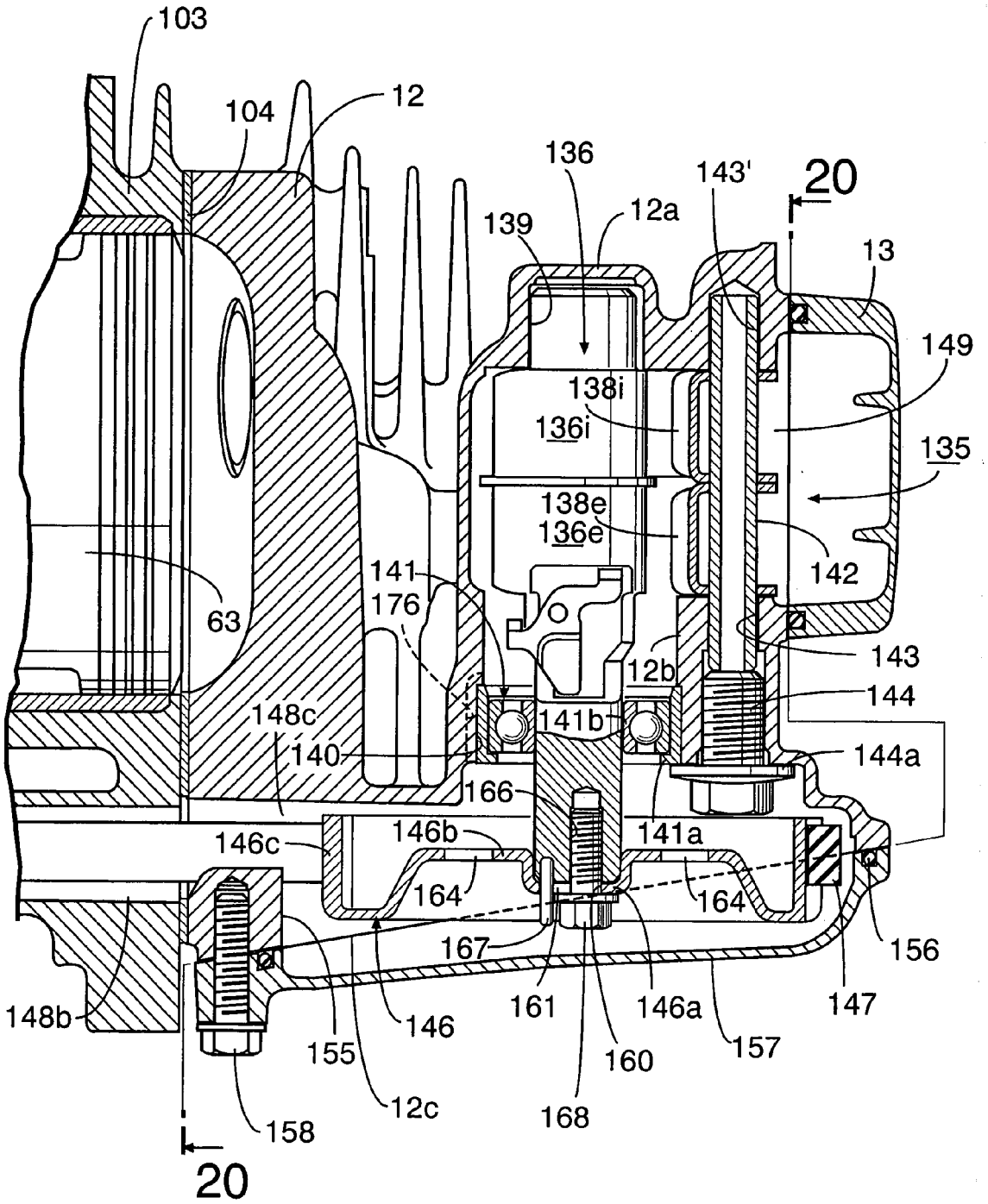
FIG. 18 is a sectional view taken along the 18-18 line in FIG. 14. (first embodiment)

First, in FIGS. 15, 16 and 18, the valve-operating system 135 comprises: a cam shaft 136 supported in parallel to the crankshaft 14 by the cylinder head 12 and having an intake cam 136*i* and an exhaust cam 136*e*; a timing transmission system 137 coupling the crankshaft 14 and the cam shaft 136 to each other; an intake locker arm 138*i* interlocking the intake cam 136*i* and the exhaust valve 129*i* with each other; and an exhaust rocker arm 138*e* interlocking the exhaust cam 136*e* and the exhaust valve 129*e* with each other.

The cam shaft 136 has its opposite ends supported by a bag-shaped shaft bearing hole 139 formed on one side wall 12*a* of the cylinder head 12, and a ball bearing 141 fitted to a bearing attachment hole 140 of the partition wall 12*b* of the intermediate portion of the cylinder head 12. A single common rocker shaft 142 rockably supporting the intake and exhaust rocker arms 138*i* and 138*e* has its opposite ends supported by first and second support holes 143' and 143 formed on the one side wall 12*a* and the partition wall 12*b*, respectively. The first support hole 143' of one side wall 12*a* is bag-shaped. The second support hole 143 of the partition wall 12*b* is through-hole-shaped. At the outer end of the second support hole 143, a fixation bolt 144 having its front end contacting the outer end of the rocker shaft 142 is threadedly attached to the partition wall 12*b*. Thus, the rocker shaft 142 is prohibited from moving in a thrust direction by the bag-shaped first support hole 143' and the fixation bolt 144.

The fixation bolt 144 integrally has, on its head, a flange seat 144*a* having a relatively large diameter. The fixation bolt 144 contacts the outer end surface of an outer lace 141*a* of the ball bearing 141 supporting the cam shaft 136.

An inner lace 141*b* of the ball bearing 141 is press-fitted into the cam shaft 136. Therefore, when the flange seat 144*a* of the fixation bolt 144 contacts the outer end of the outer lace 141*a* as described above, the cam shaft 136 is prohibited from moving in a thrust direction by the bag-shaped shaft bearing hole 139 and the flange seat 144*a*.

Therefore, both the rocker shaft 142 and the cam shaft 136 can be prohibited from moving in a thrust direction by the single fixation bolt 144, thus reducing the number of components, simplifying and downsizing the structure of the valve-operating system 135, and contributing to an improvement in assemblability of the device 135.

The timing transmission system 137 comprises: a toothed drive pulley 80 fixed on the crankshaft 14; a driven pulley 146 fixed on the cam shaft 136 and having teeth in the number twice as large as the number of teeth of the drive pulley 80; and an endless timing belt 81 wound around the drive and driven pulleys 80 and 146. Thus, the rotation of the crank shaft 14 is transmitted to the cam shaft 136 with its rotational speed reduced by ½ by the timing transmission system 137. With rotation of the cam shaft 136, the intake and exhaust cams 136*i* and 136*e* rock the intake and exhaust rocker arms 138*i* and 138*e* against urging forces of the valve springs 130*i* and 130*e*, thus opening and closing the intake and exhaust valves 129*i* and 129*e*.

The timing transmission system 137 is housed in a timing transmission chamber 148 formed by sequentially connecting the oil stirring chamber 70 defined between the bearing holder 66 and the cover member 68, an intermediate chamber 148*b* formed on the cylinder block 103 on one side of the cylinder bore 103*a*, and an upper chamber 148*c* formed on one side of the cylinder head 12. That is, the drive pulley 80 is arranged in the oil stirring chamber 70, the driven pulley 146 is arranged in the upper chamber 148*c*, and the timing belt 81 is arranged so as to pass through the intermediate chamber 148*b*. As described above, the space between the bearing holder 66 and the cover member 68 is effectively used for installation of the timing transmission system 137, thereby downsizing the engine E.

A valve-operating chamber 149 having its upper surface opened is formed between one side wall 12*a* and the partition wall 12*b* in the cylinder head 12. The intake and exhaust cams 136*i* and 136*e* of the cam shaft 136, the intake and exhaust rocker arms 138*i* and 138*e* and the other components are housed in the valve-operating chamber 149. The upper open surface of the valve-operating chamber 149 is closed by the head cover 13 jointed to the cylinder head 12 by the bolt 153.

The upper chamber 148*c* of the timing transmission chamber 148 and the valve-operating chamber 149 mutually communicate via an oil communication hole 175 (see FIGS. 20 and 23) provided on the partition wall 12*b* and a plurality of oil communication grooves 176 (see FIGS. 18 and 23) provided on the inner peripheral surface of the bearing attachment hole 140.

In FIGS. 18 to 21, the outer end surface 12*c* of the cylinder head 12 is provided with an access window 155 opening the upper chamber 148*c* so as to be faced by the outer side face of the driven pulley 146. Insertion of the driven pulley 146 into the timing belt 81 and mounting of the driven pulley 146 to the cam shaft 136 are carried out through the access window 155. A lid body 157 closing the access window 155 is jointed by a plurality of bolts 158 to the outer end surface 12*c* via a seal member 156.

As shown in FIG. 18, the outer end surface 12*c* of the cylinder head 12 to which the lid body 157 is jointed is formed to be a slanted surface 12*c* slanted so that at least a part of the outer periphery of the driven pulley 146 on the side opposite from the drive pulley 80 is exposed from the access window 155, desirably exposed from the access window 155 over the half round of the driven pulley 146 on the side opposite from the drive pulley 80.

A structure for attachment of the driven pulley 146 to the cam shaft 136 will now be described.

As shown in FIG. 18, the drive pulley 146 comprises: a bottomed cylindrical hub 146*a*; a web 146*b* radially extending from the hub 146*a*; and a toothed rim 146*c* formed on the outer periphery of the web 146*b*. The hub 146*a* is fitted to the outer periphery of the outer end of the cam shaft 136 projecting to the upper chamber 148*c* side. The end wall of the hub 146*a* is provided with a bolt hole 160 occupying a position eccentric from the center thereof and a positioning groove 161 extending from one side of the bolt hole 160 to a side just opposite to the eccentricity direction. A first match mark 162*a* is engraved on the outer side surface of the rim 146*c*. A second match mark 162*b* corresponding to the first match mark 162*a* is engraved on the outer end surface 12*c* of the cylinder head 12. The web 146*b* is provided with a plurality of open holes 164 passing therethrough.

Figure 23:
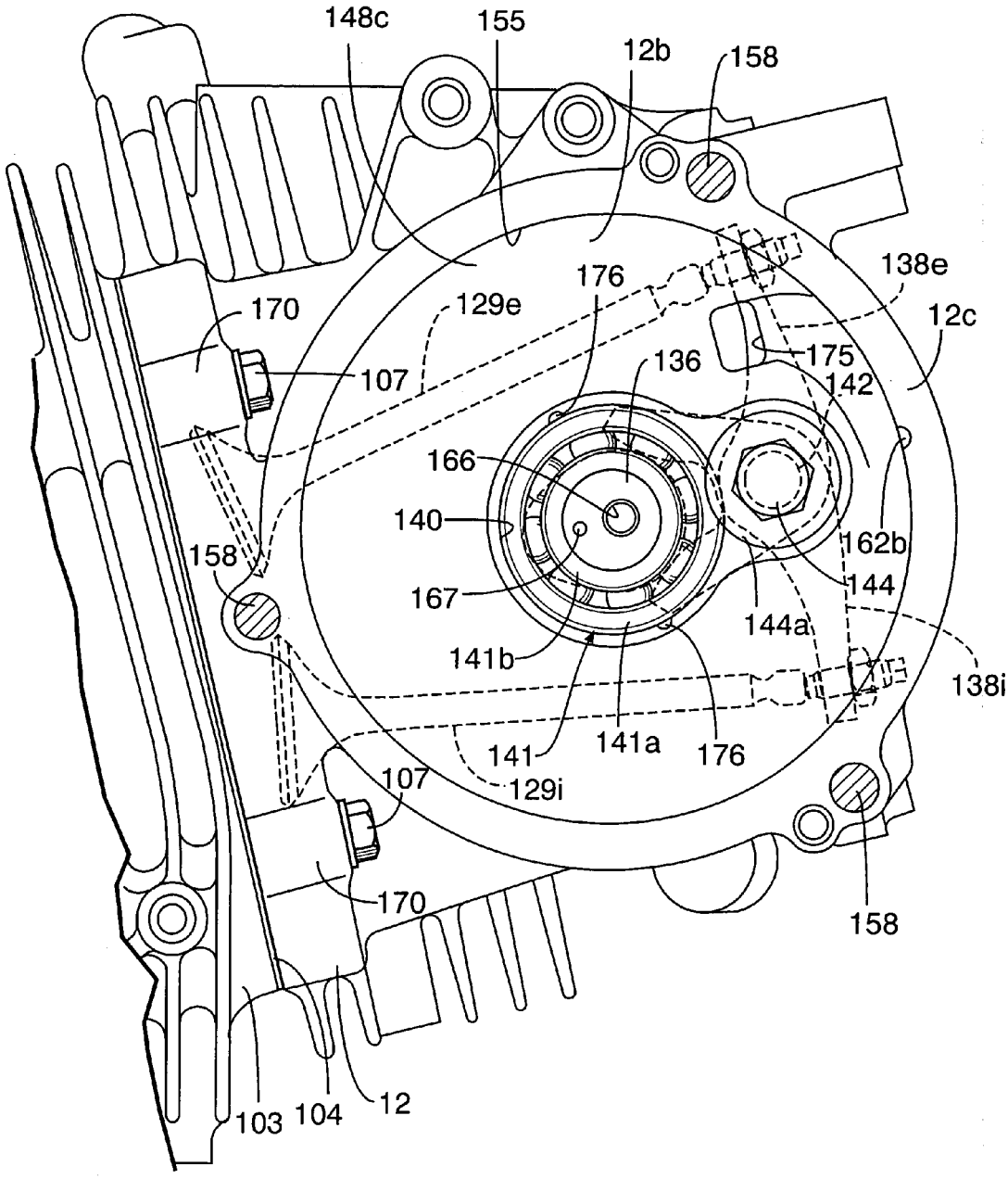
FIG. 23 is a view corresponding to FIG. 22 with a driven pulley removed. (first embodiment)
Figure 24:
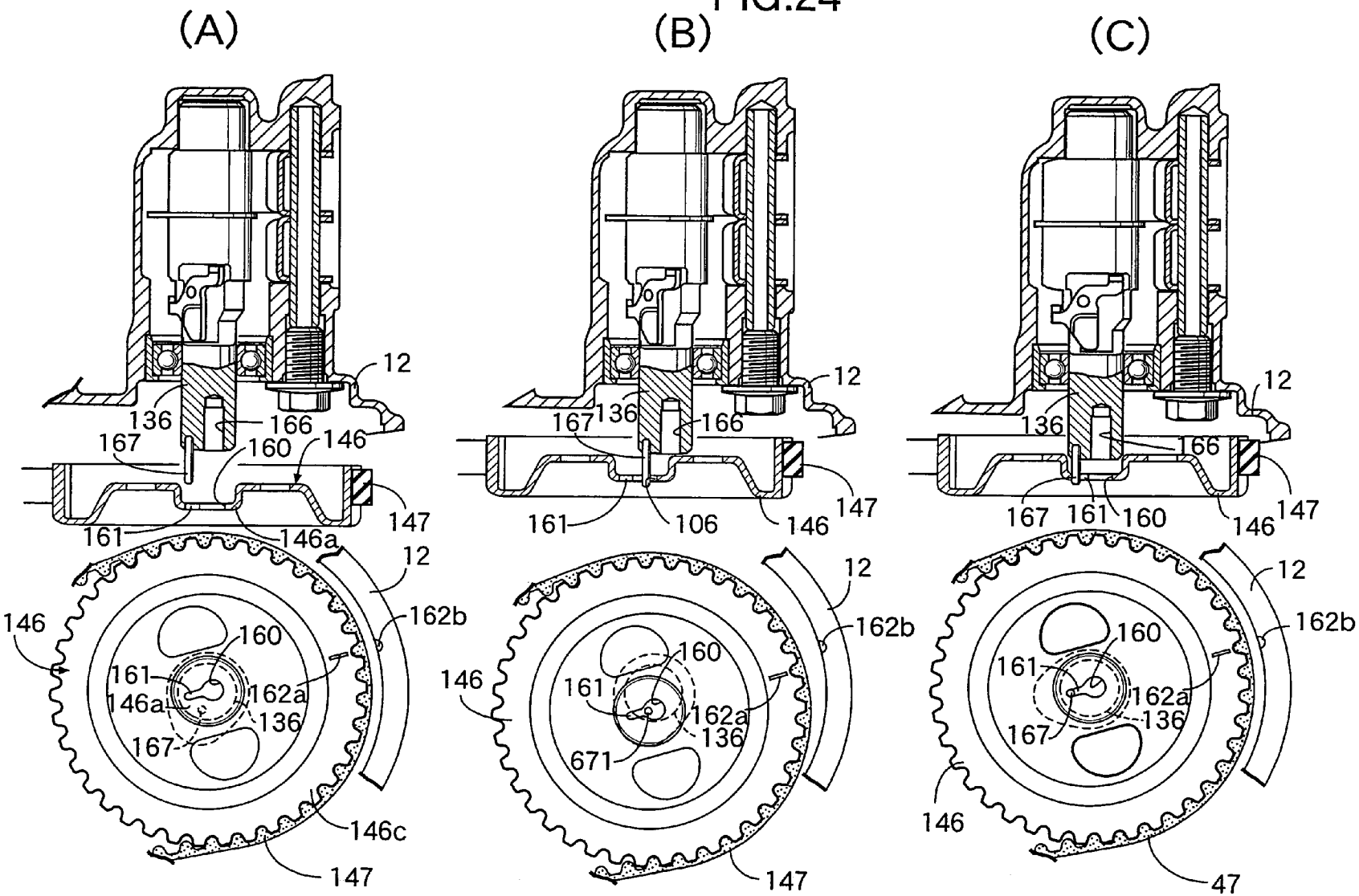
FIG. 24 are views explaining how to attach the driven pulley to a camshaft. (first embodiment)

As shown in FIGS. 18 and 23, the outer end of the cam shaft 136 is provided with a screw hole 166 corresponding to the bolt hole 160, and a positioning pin 167 corresponding to the positioning groove 161.

Thus, when the crankshaft 14 is situated at a predetermined rotational position corresponding to a specified position (e.g. upper dead center) of the piston 63, and the cam shaft 136 is situated at a position of a predetermined phase relationship with the crankshaft 14, the first match mark 162*a* and the second match mark 162*b*, the bolt hole 160 and the screw hole 166, and the positioning groove 161 and the positioning pin 167 coincide, respectively, on a line L2 passing through the centers of both the shafts 14 and 136.

For attaching the driven pulley 146 to the cam shaft 136, the crankshaft 14 is first fixed at a rotational position corresponding to the specified position of the piston 63. Next, as shown in FIG. 24(A), the driven pulley 146 is inserted into the timing belt 81 already wound around the drive pulley 80 while aligning the first match mark 162*a* of the rim 146*c* with the second match mark 162*b* of the cylinder head 12. Then, as shown in FIG. 24(B), the positioning pin 167 of the cam shaft 136 is fitted into the bolt hole 160 of the driven pulley 146; the driven pulley 146 is moved along with the timing belt 81 so as to guide the positioning pin 167 to the positioning groove 161; the cam shaft 136 rotates accordingly; the positioning pin 167 reaches the front end of the positioning groove 161; and then as shown in FIG. 24(C), the cam shaft 136 and the hub 146*a* are coaxially aligned, and at the same time the bolt hole 160 and the screw hole 166 mutually coincide.

As described above, the first and second match marks 162*a* and 162*b*, the bolt hole 160 and the screw hole 166, and the positioning groove 161 and positioning pin 167 are arranged all together on a line L2 passing through the centers of the crankshaft 14 and the cam shaft 136, by a remarkably simple operation of guiding the positioning pin 167 fitted into the bolt hole 160 to the positioning groove 161. By visually observing this state, it can easily be confirmed that the crankshaft 14 and the cam shaft 136 have established a predetermined phase relationship.

As shown in FIG. 18, a mounting bolt 168 is passed through the bolt hole 160 and threadedly fitted and tightly fastened into the screw hole 166, whereby the hub 146*a* is fixed to the cam shaft 136. In this way, the timing transmission system 137 is attached to the crankshaft 14 and the cam shaft 136 which have been attached beforehand to the crankcase 102 and the cylinder head 12 in their predetermined phase relationship.

In this case, the bolt hole 160 and the screw hole 166 are arranged at positions eccentric from the centers of the hub 146*a* and the cam shaft 136, and therefore the rotation of the driven pulley 146 can be reliably transmitted to the cam shaft 136 via the single eccentric mounting bolt 168, and the mounting bolt 168 can be prevented from being loosened.

The screw hole 166 and the positioning pin 167 are arranged at positions eccentric in mutually opposite directions from the center of the cam shaft 136, and therefore a sufficient amount of eccentricity can be given to each of the bolt hole 160 and the positioning groove 161 which are formed on the narrow end wall of the hub 146*a* of the driven pulley 146, thereby improving the positioning effect of the positioning groove 161 on the positioning pin 167 and increasing the torque capacity of the mounting bolt 168.

As described above, since the outer end surface of the cylinder head 12 in which the access window 155 is opened comprises the slanted surface 12*c*, and a part of the outer periphery of the driven pulley 146 is exposed from the access window 155, the part of the driven pulley 146 exposed to the outside of the access window 155 can be easily held by a tool or the like without being hindered by the cylinder head 12, thereby easily carrying out the operation of attaching the driven pulley 146 to the cam shaft 136, and also facilitating the detachment thereof. Thus, this can contribute to an improvement in assemblability and maintainability.

The side wall of the lid body 157 connected to the outer end surface 12*c*, that is, the slanted surface 12*c* of the cylinder head 12 is formed so as to be slanted along the slanted surface 12. With this arrangement, the engine case 11 obtains a head portion whose width is narrowing toward its tip end, thereby downsizing the engine E.

Figure 19:
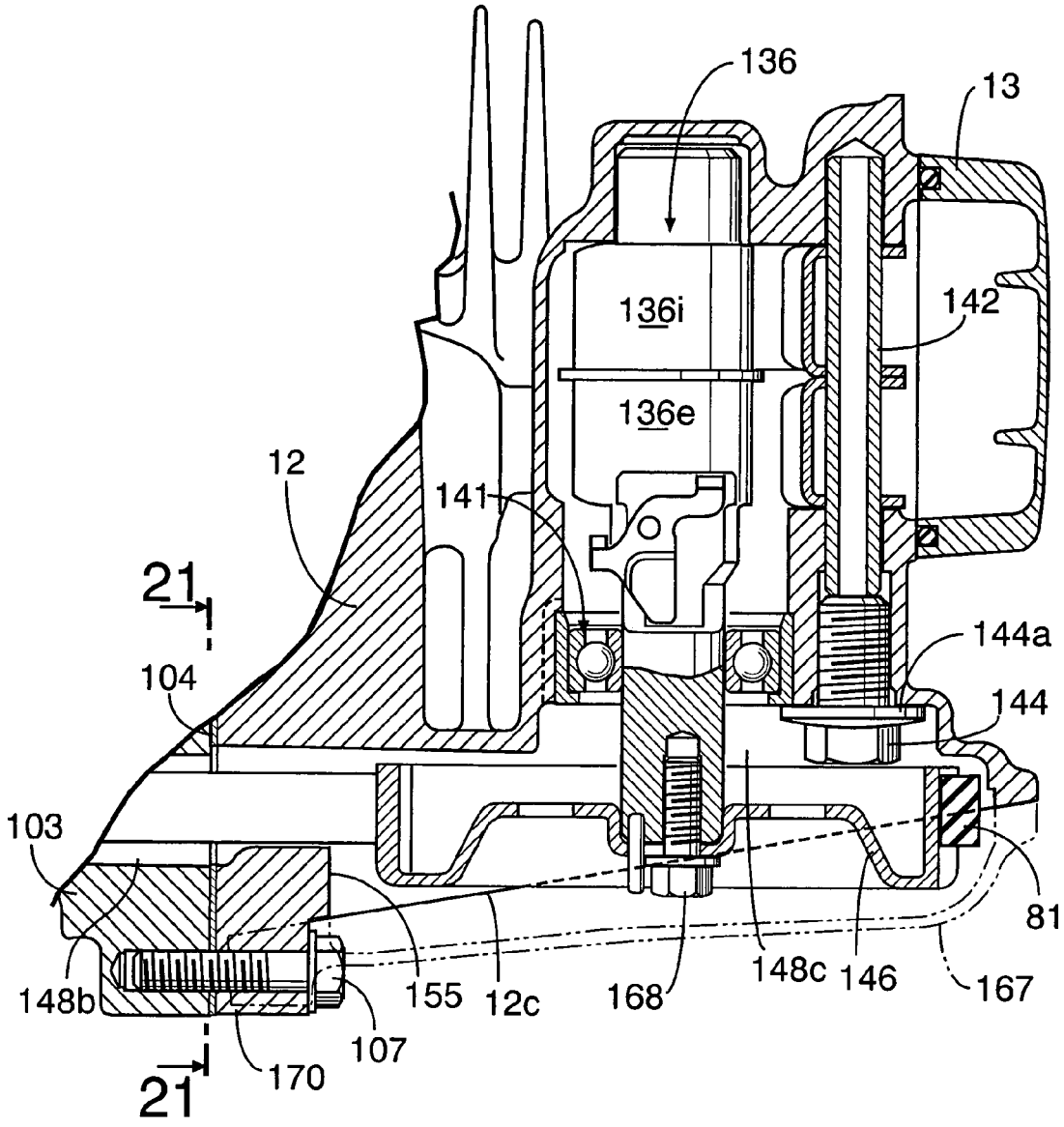
FIG. 19 is a sectional view taken along the 19-19 line in FIG. 14. (first embodiment)
Figure 20:
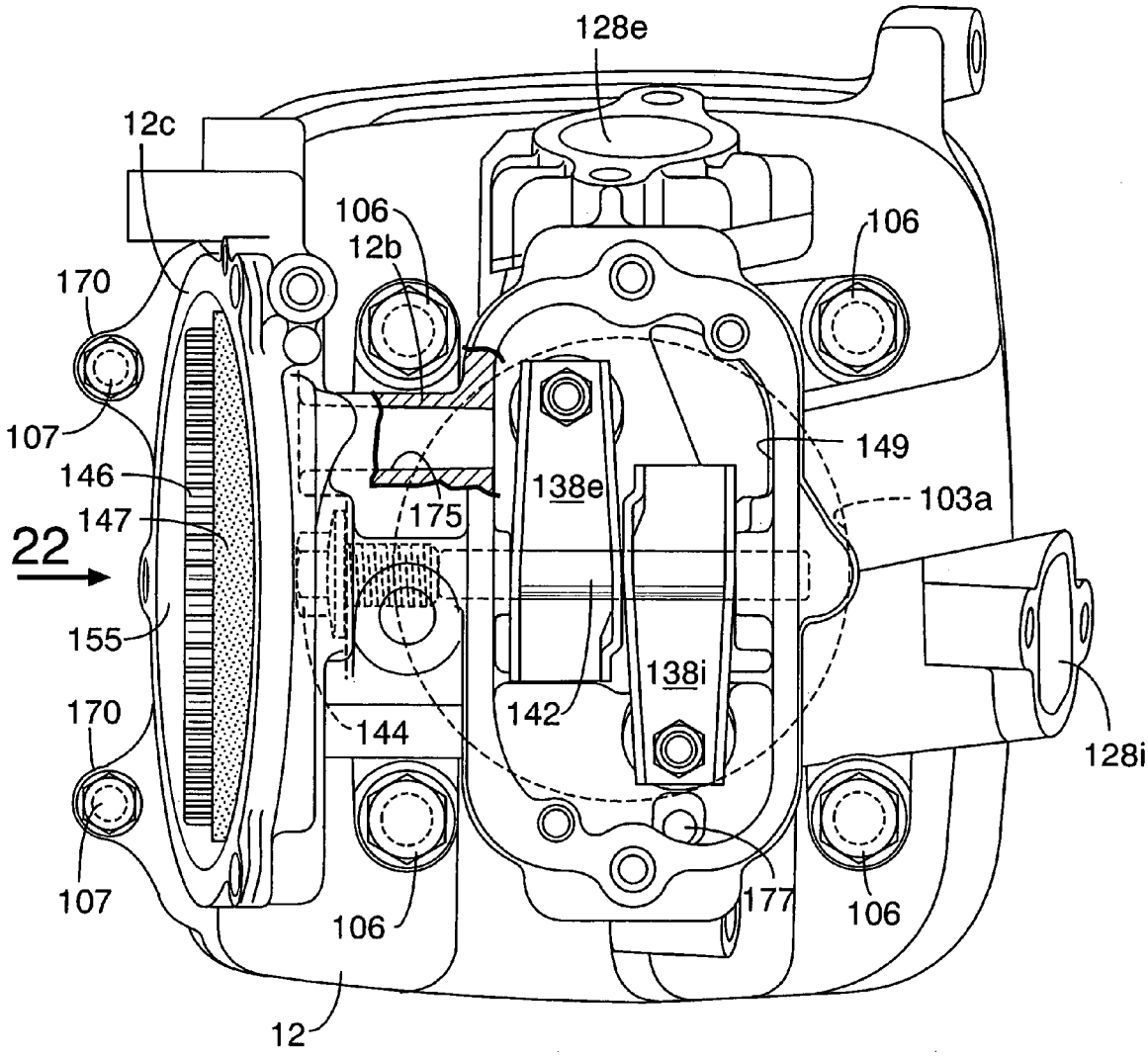
FIG. 20 is a sectional view taken along the 20-20 line in FIG. 18. (first embodiment)
Figure 21:
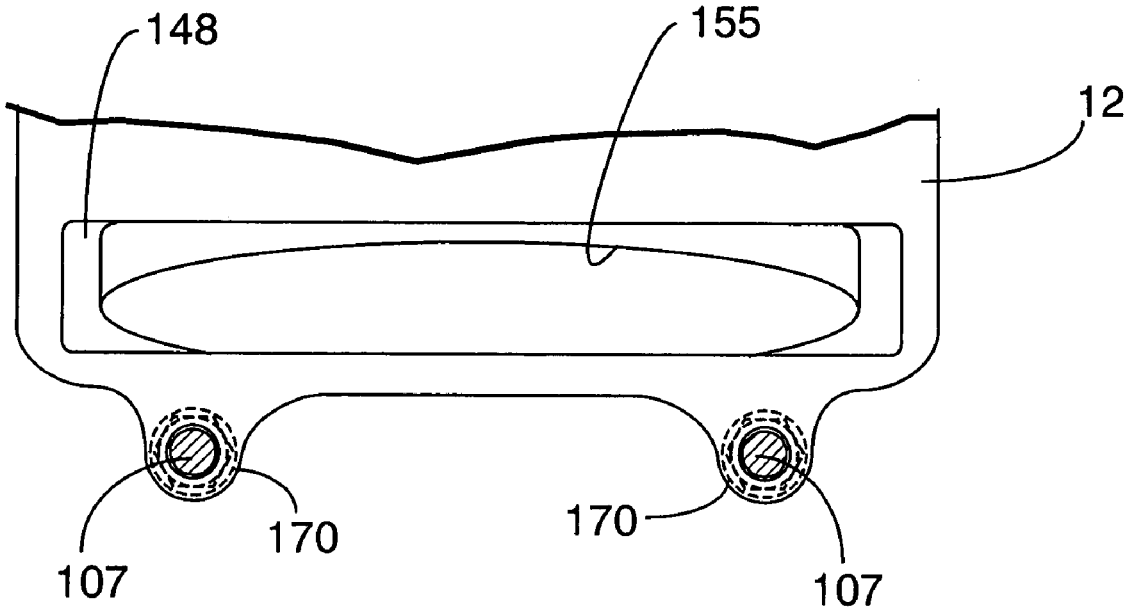
FIG. 21 is a sectional view taken along the 21-21 line in FIG. 19. (first embodiment)
Figure 22:
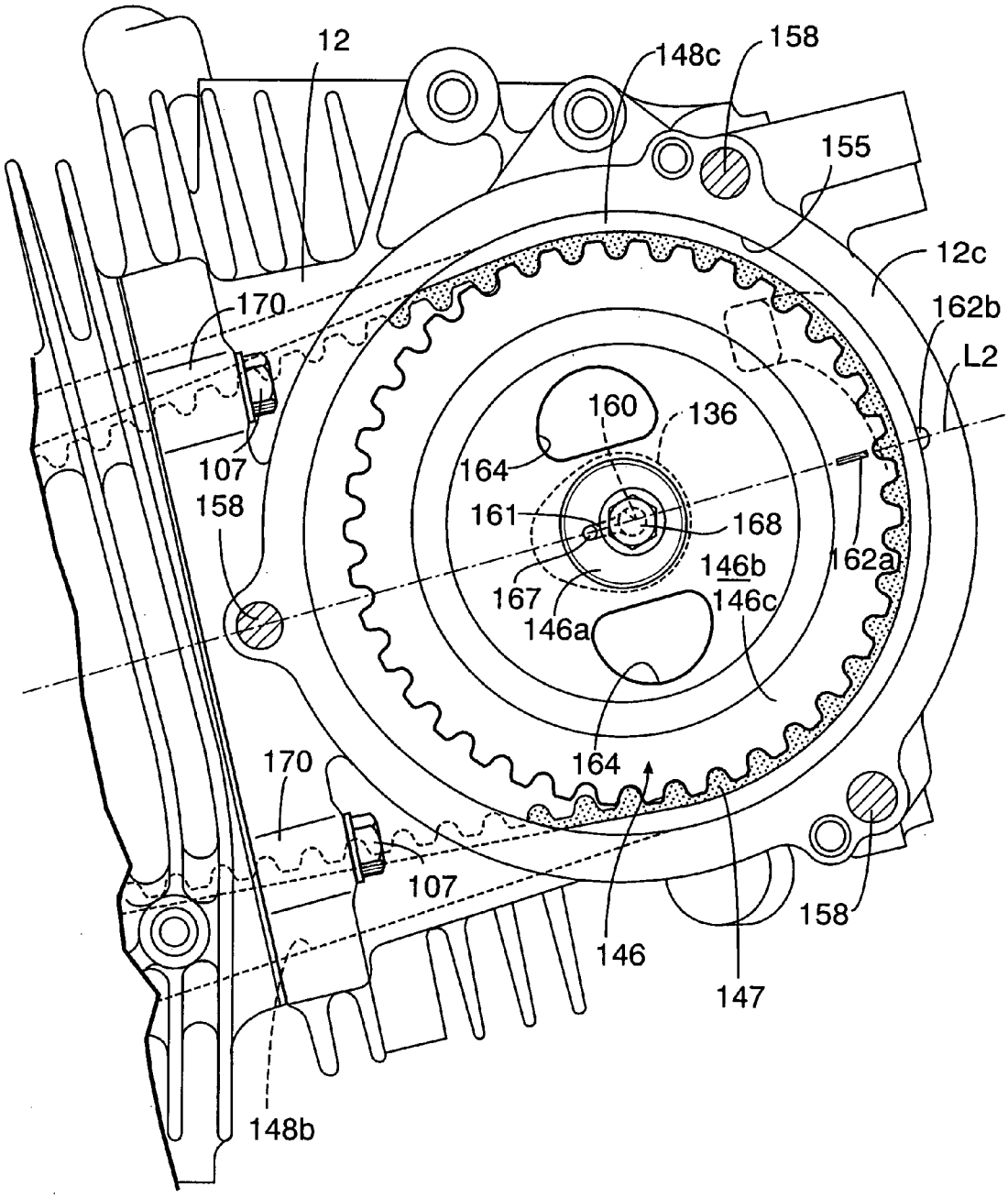
FIG. 22 is a view taken along the 22-22 line and viewed in the direction of the arrow in FIG. 20. (first embodiment)

As shown in FIGS. 19 to 21, a pair of overhang portions 170, 170 overhanging to the outside of the access window 155 below the access window 155 is formed on the cylinder head 12. The overhang portions 170, 170 are superimposed via the gasket 104 on the upper end surface of the cylinder block 103 outside the intermediate chamber 148*b*, and fastened to the cylinder block 103 by the auxiliary coupling bolts 107, 107.

By fastening with the auxiliary coupling bolts 107, 107, contact pressures of the cylinder block 103 and the cylinder head 12 on the gasket 104 can be sufficiently increased also outside the intermediate chamber 148*b* housing the timing belt 81. Moreover, a space accepting tools for manipulating the auxiliary coupling bolts 107, 107 can be sufficiently secured above the auxiliary coupling bolts 107, 107 by virtue of the presence of the slanted surface 12*c*, thereby easily carrying out the operation of the auxiliary coupling bolts 107, 107. This means that the amount of overhang of the overhang portions 170, 170 to the outside of the access window 155 can be reduced, and this also contributes to downsizing of the engine E.

The manipulation of the auxiliary coupling bolts 107, 107 is carried out before attaching the lid body 157.

Lubrication of the valve-operating system 135 will now be described.

In FIGS. 13 to 15 and FIGS. 18 and 20, the oil stirring chamber 70 of the timing transmission chamber 148 communicates with the inside of the crankcase 102, i.e., the crank chamber 109, through a plurality of step portions 108 on the inner wall of the crankcase 102 supporting the bearing holder 66. A common lubricant oil 171 is stored in a certain amount in the crank chamber 109 and the oil stirring chamber 70.

As shown in FIG. 15, the impeller-type oil slinger 77 driven via the gears 79 and 78 by the crankshaft 14 is arranged in the oil stirring chamber 70 such that a part of the oil slinger 77 is immersed in the oil 171 stored in the oil stirring chamber 70. The oil slinger 77 rotates to splash the oil 171 to its surroundings. The rib 66*b* for guiding the splashed oil to the timing belt 81 side is formed integrally on the outer side surface of the bearing holder 66 so as to surround the oil slinger 77 and the periphery of the timing belt 81 on the drive pulley 80 side. The bearing holder 66 can be easily molded together with the rib 66*b* because the bearing holder 66 is a relatively small component. Further, the bearing holder 66 integrally has the rib 66*b* to enhance its rigidity, thereby effectively improving the support rigidity of the crankshaft 14.

Thus, in the oil stirring chamber 70, the oil splashed by the oil slinger 77 is guided to the timing belt 81 by the rib 66*b*, and the oil deposited on the timing belt 81 is transferred to the upper chamber 148*c* by the belt 81. When the timing belt 81 is wound around the drive pulley 146, the oil is shaken off by a centrifugal force and splashed to the surroundings, collides against the surrounding walls to generate oil mist, and the upper chamber 148*c* is filled with the oil mist. Therefore, not only the entire timing transmission system 137 but also the ball bearing 141 of the cam shaft 136 can be lubricated.

Particularly, in the upper chamber 148*c*, a part of the oil shaken off from the timing belt 81 collides against the slanted inner surface of the lid body 157, and then bounces back to the web 146*b* of the driven pulley 146. The oil passes through the open holes 164 of the driven pulley 146, and splashes over the ball bearing 141, thereby lubricating the ball bearing 141. A part of the oil splashed over the ball bearing 141 is transferred to the valve-operating chamber 149 through the oil communication groove 176 on the outer periphery of the bearing 141, and lubricates also from the ball bearing the valve-operating chamber 149 side. Thus, the ball bearing 141 is excellently lubricated.

Figure 14:
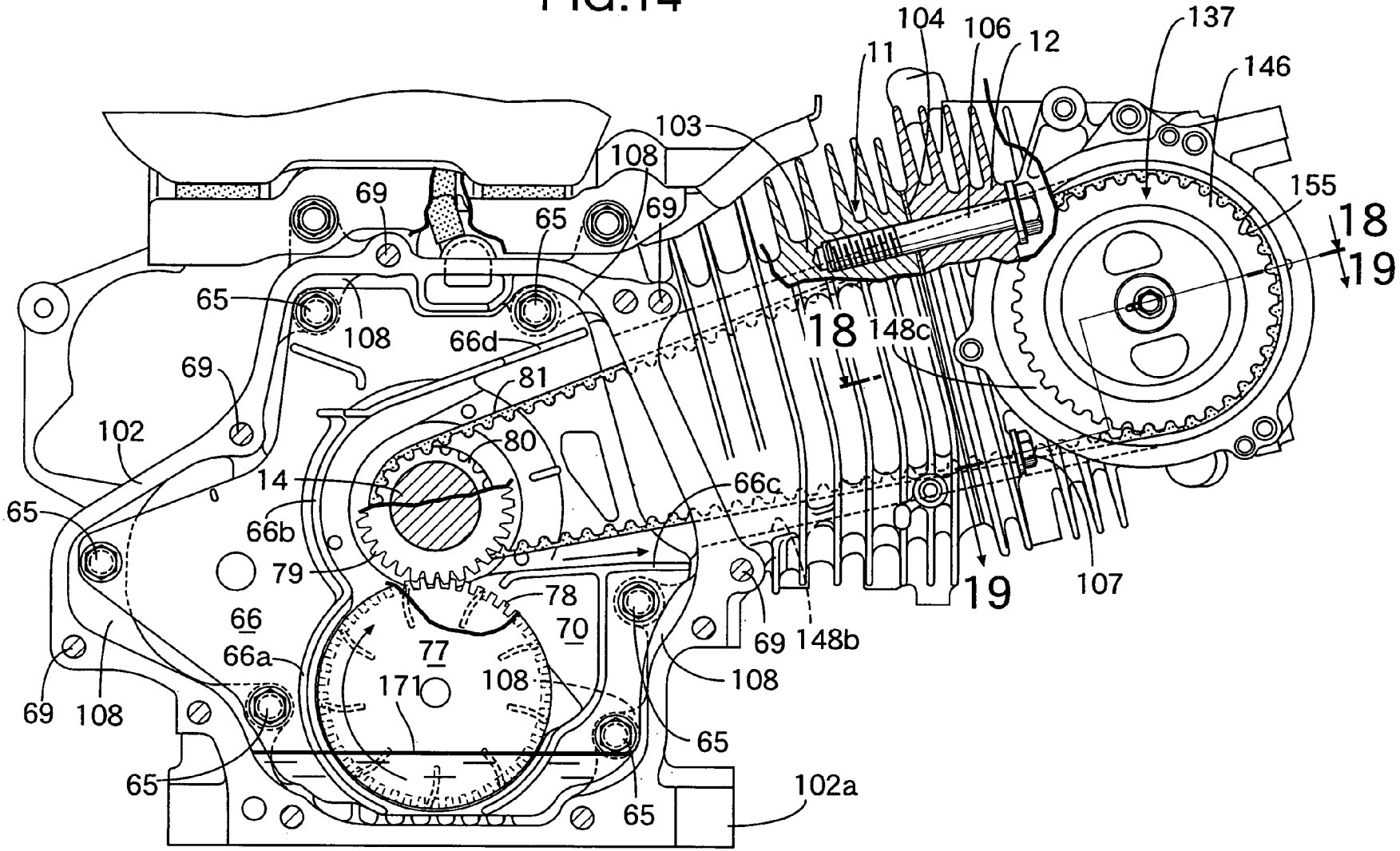
FIG. 14 is a sectional view taken along the 14-14 line in FIG. 13. (first embodiment)

As shown in FIG. 14, the bottom of the valve-operating chamber 149 communicates with the crank chamber 109 via a train of oil return channel 177 formed in the cylinder head 12 and the cylinder block 103 so as to extend along one side of the cylinder bore 103*a*. The oil return channel 177 is inclined toward the crank chamber 109 so that the oil flows down from the valve-operating chamber 149 to the crank chamber 109.

During operation of the engine E, a pulsation of pressure is generated in the crank chamber in association with the up-and-down movement of the piston 63. When the pulsation pressure is transmitted to the valve-operating chamber 149 and the timing transmission chamber 148 through the oil return channel 177, the oil communication hole 175 and the oil communication groove 176, the oil mist travels between the valve-operating chamber 149 and the timing transmission chamber 148. Therefore, the entire valve-operating system 135 can be effectively lubricated.

After the lubrication, the oil stored in the valve-operating chamber 149 flows down through the oil return channel 177 back into the crank chamber 109. The bottom of the timing transmission chamber 148 is also inclined toward the oil stirring chamber 70, and thus the oil stored in the upper chamber 148*c* flows down through the intermediate chamber 148*b* back into the oil stirring chamber 70.

As described above, the operation of the oil slinger 77 and the timing transmission system 137, and the pulsation pressure of the crank chamber 109 can be utilized to lubricate, by the oil mist, the insides of the mutually defined timing transmission chamber 148 and the valve-operating chamber 149 which are partitioned from each other. Therefore, an oil pump is unnecessary, thus simplifying and downsizing the structure of the engine E and reducing the cost. Moreover, the cam shaft 136 can maintain the overhead arrangement of the intake and exhaust valves 129*i* and 129*e*, thereby ensuring a desired output performance of the engine.

The embodiment of the present invention has been described above, but various modifications in design can be made to the present invention within the scope of the invention.

For example, the general-purpose engine E has been described in the embodiment, but the present invention may be applied to an engine for any purpose.

In the embodiment, the ribs 66*d*, 66*e*, 68*a* and 68*b* forming the labyrinth 82 of the gas-liquid separation device 61 project from both the bearing holder 66 and the cover member 68, but may project from only one of them.

The belt-type timing transmission system 137 may be replaced by a chain-type timing transmission system.

The invention claimed is:

1. A gas-liquid separation device of an engine for separating oil mist from air in an engine case, the gas-liquid separation device comprising:

a bearing holder having a bearing rotatably supporting a crankshaft is fixed to face an opening of the engine case; and a gas-liquid separation chamber formed between a cover member covering the opening and the bearing holder, wherein ribs project from the cover member parallel relative to a longitudinal axis extending through a journal portion of the crankshaft and towards the bearing holder to form a labyrinth in the gas-liquid separation chamber.

2. The gas-liquid separation device of an engine according to claim 1, wherein the labyrinth is further formed by ribs projecting from the bearing holder towards the cover member.

3. The gas-liquid separation device of an engine according to claim 2, wherein the ribs projecting from the cover member and the ribs projecting from the bearing holder mutually overlap to form the labyrinth.

4. The gas-liquid separation device of an engine according to any one of claims 1, 2, and 3, wherein the air from which the oil mist is separated in the gas-liquid separation chamber is guided through a breather channel to a breather device to further perform gas-liquid separation.

5. The gas-liquid separation device of an engine according to claim 4, wherein the breather channel is arranged on an upper part of the engine case.

6. The gas-liquid separation device of an engine according to claim 1, wherein a part of the engine case is formed by a crank case having the opening on one side; wherein a plurality of step portions facing the opening and aligned along a circumferential direction are formed on the inner peripheral wall of the crankcase; and wherein a reinforcement rib surrounding the plurality of step portions is formed integrally on an outer peripheral surface of the crankcase.

7. The gas-liquid separation device of an engine according to claim 6, wherein a cylinder block is formed integrally on the crankcase to form the engine case, and an end of the reinforcement rib is connected integrally to the outer side wall of the cylinder block.

8. The gas-liquid separation device of an engine according to claim 6 or 7, wherein an oil stirring chamber communicating with a crank chamber in the crankcase is defined between the bearing holder and the cover member, and a drive rotation member fixed on the crankshaft of a timing transmission system for valve operation is arranged in the oil stirring chamber.

9. The gas-liquid separation device of an engine according to claim 8, wherein an oil slinger driven by the crankshaft to splash a lubricant oil stored in the oil stirring chamber is arranged in the oil stirring chamber, and a rib for guiding the lubricant oil splashed by the oil slinger to the timing transmission system side is formed in the bearing holder.

10. A gas-liquid separation device of an engine for separating oil mist from air in an engine case, the gas-liquid separation device comprising:

a bearing holder having a bearing rotatably supporting a crankshaft is fixed to face an opening of the engine case; and a gas-liquid separation chamber formed between a cover member covering the opening and the bearing holder, wherein ribs project from the cover member parallel relative to a longitudinal axis extending through a journal portion of the crankshaft and towards the bearing holder to form a first labyrinth in the gas-liquid separation chamber, and wherein gas separated by the first labyrinth in the gas-liquid separation chamber passes through a breather channel, is fed to a breather chamber, and then passes through a second labyrinth formed by the ribs projecting from the cover member into the breather chamber.

11. The gas-liquid separation device of an engine according to claim 10, wherein the first labyrinth is further formed in the gas-liquid separation chamber by ribs projecting from the bearing holder towards the cover member.

12. The gas-liquid separation device of an engine according to claim 11, wherein the ribs projecting from the cover member and the ribs projecting from the bearing holder mutually overlap to form the first labyrinth.

13. The gas-liquid separation device of an engine according to claim 10, wherein the breather channel is arranged on an upper part of the engine case.

14. The gas-liquid separation device of an engine according to claim 10, wherein a part of the engine case is formed by a crank case having the opening on one side; wherein a plurality of step portions facing the opening and aligned along a circumferential direction are formed on the inner peripheral wall of the crankcase; and wherein a reinforcement rib surrounding the plurality of step portions is formed integrally on an outer peripheral surface of the crankcase.

15. The gas-liquid separation device of an engine according to claim 14, wherein a cylinder block is formed integrally on the crankcase to form the engine case, and an end of the reinforcement rib is connected integrally to the outer side wall of the cylinder block.

16. The gas-liquid separation device of an engine according to claim 15, wherein an oil stirring chamber communicating with a crank chamber in the crankcase is defined between the bearing holder and the cover member, and a drive rotation member fixed on the crankshaft of a timing transmission system for valve operation is arranged in the oil stirring chamber.

17. The gas-liquid separation device of an engine according to claim 16, wherein an oil slinger driven by the crankshaft to splash a lubricant oil stored in the oil stirring chamber is arranged in the oil stirring chamber, and a rib for guiding the lubricant oil splashed by the oil slinger to the timing transmission system side is formed in the bearing holder.

18. The gas-liquid separation device of an engine according to claim 1, wherein additional ribs are projectingly provided on one of the bearing holder and the cover member and define an oil stirring chamber between the bearing holder and the cover member, wherein an oil slinger rotated by the crankshaft and an element of a timing transmission system are positioned in the oil stirring chamber, and wherein air-conditioning oil mist generated by the oil slinger flows from the oil stirring chamber to the gas-liquid separation chamber.

* * * * *